US010551797B2

(12) United States Patent
Bishop

(10) Patent No.: US 10,551,797 B2
(45) Date of Patent: Feb. 4, 2020

(54) TIME DISPLAY, METHOD OF PRESENTING TIME INFORMATION AND TIMEKEEPING DEVICES

(71) Applicant: Timothy Bishop, Paris (FR)

(72) Inventor: Timothy Bishop, Paris (FR)

( * ) Notice: Subject to any disclaimer, the term of this patent is extended or adjusted under 35 U.S.C. 154(b) by 0 days.

(21) Appl. No.: 15/122,142

(22) PCT Filed: Feb. 28, 2014

(86) PCT No.: PCT/IB2014/000233

§ 371 (c)(1),
(2) Date: Aug. 26, 2016

(87) PCT Pub. No.: WO2015/128688

PCT Pub. Date: Sep. 3, 2015

(65) Prior Publication Data

US 2016/0378067 A1 Dec. 29, 2016

(51) Int. Cl.
*G04G 9/00* (2006.01)

(52) U.S. Cl.
CPC ..... *G04G 9/00* (2013.01)

(58) Field of Classification Search
CPC ..... G04G 9/00; G04G 9/0017–0058; G09B 19/12; A63F 3/0497
See application file for complete search history.

(56) References Cited

U.S. PATENT DOCUMENTS

| | | | | |
|---|---|---|---|---|
| 2,252,321 A * | 8/1941 | Keller | G04F 8/003 218/7 |
| 3,775,964 A | 12/1973 | Fukumoto | 58/50 R |
| 4,092,823 A | 6/1978 | Shiro | 58/125 |
| 4,752,919 A | 6/1988 | Clark | 368/223 |
| 5,214,624 A | 5/1993 | Siebrasse | 368/82 |
| 5,331,609 A | 7/1994 | Gubin | 368/223 |
| 5,694,376 A | 12/1997 | Sullivan | 368/82 |
| 5,757,731 A | 5/1998 | Rosenberg | 368/242 |
| 5,896,348 A | 4/1999 | Lyon | 368/223 |
| 6,256,265 B1 | 7/2001 | Sepulveda | 368/82 |

(Continued)

FOREIGN PATENT DOCUMENTS

| | | | |
|---|---|---|---|
| DE | 19923808 | 11/2000 | G04B 19/00 |
| DE | 19923808 A1 | 11/2000 | G04B 19/00 |

(Continued)

OTHER PUBLICATIONS

International Preliminary Report on Patentability issued in application No. PCT/IB2014/000233, dated Sep. 6, 2016 (5 pgs).

(Continued)

*Primary Examiner* — Edwin A. Leon
*Assistant Examiner* — Jason M Collins
(74) *Attorney, Agent, or Firm* — Hayes Soloway P.C.

(57) ABSTRACT

A timepiece, time display, and method of presenting time information. The timepiece includes clock means for measuring the passage of time in standard units, and maintaining a current value. A visual display is included for displaying one of the standard units of the current value at a time. The time piece further comprises means for selecting one of the standard units and presenting the selected unit of the current value on the visual display. The current value is represented by the position of an indicator within a defined space on the visual display.

20 Claims, 21 Drawing Sheets

(56) References Cited

U.S. PATENT DOCUMENTS

| | | | | |
|---|---|---|---|---|
| 6,628,571 | B2 | 9/2003 | Emami | 368/82 |
| 7,079,454 | B2 * | 7/2006 | Wellen | G04B 25/02 368/223 |
| 7,362,662 | B2 | 4/2008 | Lang | 368/232 |
| 7,525,877 | B2 * | 4/2009 | Harrison, Jr. | G04B 25/00 368/11 |
| 8,111,589 | B2 * | 2/2012 | Vidal | G04G 9/047 368/242 |
| 8,844,862 | B2 | 9/2014 | Journade | 244/54 |
| 9,575,466 | B1 * | 2/2017 | Thompson | G04B 47/06 |
| 2004/0233788 | A1 | 11/2004 | Plancon et al. | 368/11 |
| 2005/0052953 | A1 | 3/2005 | Kent | 368/82 |
| 2005/0185519 | A1 * | 8/2005 | Kent | G04G 9/00 368/239 |
| 2008/0205198 | A1 * | 8/2008 | Sherman | G04B 45/0092 368/62 |
| 2009/0098321 | A1 | 4/2009 | Zielinki et al. | 428/34.6 |
| 2010/0051743 | A1 | 3/2010 | Dumont et al. | 244/5 |
| 2011/0155847 | A1 | 6/2011 | Journade et al. | 244/54 |
| 2013/0105622 | A1 | 5/2013 | Journade | 244/54 |
| 2014/0098648 | A1 * | 4/2014 | Breckman | G04B 45/00 368/228 |
| 2015/0117162 | A1 * | 4/2015 | Tsai | G09B 19/12 368/29 |
| 2015/0198929 | A1 * | 7/2015 | Essery | H04W 88/02 368/46 |

FOREIGN PATENT DOCUMENTS

| | | | |
|---|---|---|---|
| EP | 2583900 A2 | 4/2013 | B64C 7/02 |
| GB | 2014337 | 8/1979 | G04C 3/00 |
| GB | 2014337 A | 8/1979 | G04C 3/00 |

OTHER PUBLICATIONS

International Search Report issued in application PCT/IB2014/000233, dated Oct. 31, 2014 (4 pgs).

Written Opinion issued in application No. PCT/IB2014/000233 dated Aug. 31, 2016 (4 pgs).

International Search Report, PCT/IB2014/000233, dated Sep. 1, 2014 (3 pgs).

International Search Report, PCT/IB2014/000233, dated Oct. 31, 2014 (3 pgs).

International Preliminary Report on Patentability and Written Opinion of the International Searching Authority, PCT/EB2014/000233 dated Sep. 6, 2015 (6 pgs).

* cited by examiner

TIME DISPLAY, METHOD OF PRESENTING TIME INFORMATION AND TIMEKEEPING DEVICES

FIELD OF INVENTION

The present invention relates to time displays, and more particularly, to a novel time display, method of presenting time information and timekeeping devices.

BACKGROUND OF THE INVENTION

Traditional analog timepieces have been in use for centuries. They rely on the use of indicators, in the form of arms or hands, that overlap and rotate around a common central point to simulate the passage of time. Each indicator represents a standard unit of time. The current time is indicated by the position of the indicators relative to markers inscribed on a circular scale concentric to the point of rotation.

The circular scale permits the units of time (e.g., hours, minutes, seconds) to be measured easily and intuitively by viewing the position of the separate indicators with respect to the (same) scale. By depicting the standard units of time simultaneously within the same display structure, traditional analog timepieces are efficient and precise in the display of time, explaining their appeal and longevity. The circular, integrated display structure of the traditional analog timepiece also enabled the development of efficient mechanical movement technologies. These visual and technical advantages ensured that this analog form of time depiction became highly standardized and universally adopted.

The advance of electronic timekeeping and, in particular, digital electronic displays, such as light-emitting diodes (LEDs) and liquid-crystal displays (LCDs), challenged the dominance of the traditional analog timepiece. In particular, the use of digital numeric LED or LCD displays emphasized the idea of precision by reducing time depiction to the presentation of discrete numerical time values. Digital numeric displays eliminate the need for a system of scales and markers and capture the passage of time in a step-wise, incremental manner, thus reducing the scope for error in reading the time. These displays also enable the elimination of mechanical parts and the integration of other, non-timekeeping functions that require numerical read-outs, such as calculators.

Despite their advantages, traditional analog and digital numeric time displays impose a restrictive mould on time depiction. As a result, there have been attempts to introduce alternative ways of displaying the time. Some proposals are variations of the traditional analog display, such as U.S. Pat. No. 5,694,376 (Sullivan) which seeks to incorporate new technologies such as LEDs. LCDs and other electronic technologies have been used to provide new analog alternatives to digital numeric displays. For example, U.S. Pat. No. 7,362,662 (Lang) employs electronic linear segments to display the time. A linear approach to time depiction has been proposed by others, for instance based on electromechanical systems (e.g., U.S. Pat. No. 4,092,823 (Shiro), U.S. Pat. No. 5,331,609 (Gubin)) or electronic systems (e.g., U.S. Pat. No. 3,775,964 (Fukumoto), U.S. Pat. No. 5,214,624 (Siebrasse), and U.S. Pat. No. 6,256,265 (Sepulveda)).

Hybrids that combine traditional, numeric, and linear approaches to timekeeping have also been developed. For instance, Clark in U.S. Pat. No. 4,752,919 uses a numeric display to indicate the hours and a linear segment to indicate the progression of minutes within the hour, while Rosenberg in U.S. Pat. No. 5,757,731 uses a numeric display to indicate the hours and minutes and a linear segment to indicate the progression of the hour. The time displays in Lyon in U.S. Pat. No. 5,896,348 and Emami in U.S. Pat. No. 6,628,571 represent the numerical values of hours, tens of minutes, and minutes by a corresponding number of illuminated or filled segments arranged in three successive columns (e.g., 12, 5 and 9, respectively, to represent 12:59).

Furthermore, with the development of "smart watches" and similar devices with digital displays that have the capacity to perform time-linked functions or present time-linked information on the same display device (e.g., calendar, timeline, activity, task or process linked to time such as directions for driving), there is now specifically a need to develop an alternative way of depicting the time that easily incorporates these time-linked functions or information directly into the time display in a manner that is simple, compact, and visually intuitive and does not compromise precision in timekeeping. Such an approach would enable better visualization of the time content of information, facilitate the presentation of such information on small digital displays (e.g., on wristwatches), and enhance the ability of users to manipulate such information directly on the time display.

Despite efforts to improve time display methods and employ new technologies, current timekeeping displays, time presentation methods, and timekeeping devices suffer from one or more of the following three, interrelated problems: 1) they require, for their very operation and the reading of time, a substantive spatial area or particular physical layout for the time display; 2) they are unable, due to their structure, layout or mode of operation, to maximize the flexibility and design potential of digital display technologies, which greatly expand the ways in which time can be depicted; and 3) they face important constraints in their ability to incorporate time-linked information into the time display.

Specifically, traditional analog timepieces must allocate a substantive spatial area on a watch or clock face in order to allow for the placement of a circular or equivalent type of dial and permit the full rotation of discernable indicators (e.g., arms), both of which are necessary for the measurement of time. Moreover, the need for a circular or equivalent structure for the dial on these timepieces imposes limitations on their configuration and design. These structural constraints remain evident in electronic versions of traditional analog timepieces, which are unable to exploit versatile digital display technologies; they typically mimic their mechanical counterparts in form and operation. Such constraints limit the scope for introducing time-linked information on the display, as the display, with its multiple rotating indicators, would largely obstruct the presentation of such information. The presentation of time-linked information within this type of display is problematic for another reason; with the use of multiple indicators on the same dial, there is scope for confusion regarding the specific unit of time to which such information is being linked.

While timepieces employing digital numeric displays do not require as much space as current analog timepieces, they impose, by their very nature, a particular physical layout and presentation of time information. While the use of standardized numeric forms means that they can be easily read, there is very limited scope for variation or innovation in the display of time. The flexibility in time display permitted by such display technologies as LCD is thus left underutilized. Moreover, the use of digital numerical displays limits the incorporation of time-linked information into the time display. Such information can merely be juxtaposed with the numerical time values, precluding a more visual, analog-form presentation in which time values contained in information or functions can be directly linked into the time display and time intervals can be visualized on the display.

Other current methods for depicting the time, while less tied to a specific physical structure or layout as traditional analog or digital numeric timepieces, also face one or more of the aforementioned problems.

There is therefore a need for a novel approach to timekeeping and the presentation of time information that can provide for a more economical use of space, enhance flexibility in the depiction of time, enable the incorporation of time-linked functions or information, and expand the use of technology, thereby improving on previous time displays and methods.

SUMMARY OF THE INVENTION

It is an object of the invention to provide an improved time display, method of presenting time information, and time-presenting displays and devices.

One aspect of the invention is directed to a timepiece comprising: clock means for measuring the passage of time, in standard units, and maintaining a current value; a visual display, for displaying one of the standard units of the current value at a time; and means for selecting one of the standard units of the current value and presenting the selected one of the standard units of the current value, on the visual display; wherein the current value is represented by the position of an indicator within a defined space on the visual display.

Another aspect of the invention is directed to a time display for a clock system having a clock means for measuring the passage of time, in standard units, and maintaining a current value, the time display comprising: a visual display, for displaying one of the standard units of the current value at a time; and means for selecting one of the standard units of the current value and presenting the selected one of the standard units of the current value, on the visual display; where the current value is represented by the position of an indicator within a defined space on the visual display.

A further aspect of the invention is directed to a method of presenting time information comprising: operating a clock means to measure the passage of time, in standard units, and to maintain a current value; providing a visual display, for displaying one of the standard units of the current value at a time; providing a means for selecting one of the standard units of the current value and presenting the selected one of the standard units of the current value, on the visual display; and providing an indicator, where the current value is represented by the position of the indicator within a defined space on the visual display.

In one embodiment of the invention, time is depicted as the movement of an indicator or set of indicators through a defined space, for example, through a segment or group of segments, up to sixty in number. The progression of each of the standard units of time, such as the hours, minutes, and seconds, is depicted and measured using the same segment or group of segments, with only one standard unit of time displayed at any given moment. The reading of the other standard units of time is obtained by means of switching between different time "layers", "modes" or "states". Possible markers demarcating time intervals within or across the segment(s) may be used to facilitate the reading of time.

This new approach compresses the depiction of time. Only one indicator and, should they be employed in the display, only one segment or a single group of segments, are necessary for the display of time. This approach sacrifices immediate readability of time (i.e., the ability to discern, at once, the hours, minutes, and seconds) in order to obtain important practical advantages and design benefits, described below. Accuracy in timekeeping is nonetheless maintained, obtained by switching between time layers.

Fundamental to this approach is the notion of "nesting" of time depiction. Specifically, the approach emphasizes, by means of layering the depiction of each of the standard units of time within the same visual display, the idea that each standard unit can be visually "unwrapped" into its constituent sub-units (e.g., minutes within each hour, seconds within each minute), thereby simplifying time depiction and establishing a hierarchy for standard time units. This approach contrasts with the long-ingrained tradition of producing timepieces in which the progression of each of the standard units of time is shown simultaneously, which assumes that each standard unit has equal significance—an approach that places limitations on the size, configuration, and design of time displays.

Embodiments of the invention provide a novel time display, method of presenting time information, and timekeeping devices that retain strong visual appeal and economy in time display and can exploit the design possibilities and interactive interfaces of current display technologies, thereby offering opportunities for entirely new types of innovative, yet intuitive, time displays and time-linked applications and tools.

In particular, an object of the present invention is to reduce the number of indicators and segments, and any related markers, required to display and measure the time, without compromising accuracy. Benefits include: simplification of time depiction and de-cluttering of timepieces; reduction in space requirements for timekeeping, enabling for instance further miniaturization, e.g., embedding time displays in jewellery; increased scope to introduce, view, and manipulate time-linked functions or information on the time display; ability to embed, in a simple manner, other functionalities within any segment(s) used for the time display; fewer components and material; and lower power consumption.

Another object of the present invention is to provide for enhanced flexibility and versatility in the design of time displays and timepieces and the presentation of time information. With the complexity of the time display greatly reduced in terms of indicators and segments, and the display unconstrained by the structures imposed by traditional analog technology (i.e., dial), digital numeric technology (i.e., sequential display of numbers, placed side by side), or newer time display methods that require separate displays for the hours, minutes, and seconds, or multiple sets of indicators and markers, the degree of freedom in designing time displays is vastly increased. In this way, the depiction of time information is capable of being integrated into a considerably wider range of design layouts and physical configurations. Under this invention, the very design of the time display determines how time information is to be depicted and measured on the timepiece.

With this invention, time information can be displayed on any device, object, structure, or medium, in two or three dimensions (e.g., timepiece, jewellery, computer, telephone or mobile phone, key chain, cylinder, pyramid, tower, screen, wall or projection on a wall). The segment or group of segments that may be used to depict time information can be any shape or size, and may be fixed or variable (e.g., programmable) in these respects as well in respect of the number of segments (e.g., shape, size or number varying as time progresses, varying in accordance with another changing factor, varying depending on the standard unit of time being displayed or upon selection of the user, or varying randomly), with scope for customization by the user. Also, any segment or group of segments employed in the visual display can be arranged in any desired manner, whether fixed and pre-set in advance or customized by the user. A dynamic element may be introduced; for instance, the arrangement of segments may vary with the passage of time, vary in accordance with another changing factor, vary depending on the standard unit of time being displayed or upon selection of the user, vary randomly, etc. This flexible, unconstrained approach easily permits, for instance, the depiction of time on the edge of a thin bracelet, which would not be possible or would at least be very difficult to read with current time depiction methods.

This novel approach thus increases the ability to vary the design of time displays and the shape and form of timepieces, and facilitates the integration of sculptural and architectural elements into timepieces. It provides substantial scope for other fields of art and design, such as print and textile design, light design, fashion, and architecture, to inspire the design of time displays; as noted, it permits time depiction to be entirely customized by the user. The design flexibility inherent in the invention enables the technical capacities and flexibility of modern digital display technologies—which allow time displays to take on any form in the display—to be fully exploited in timekeeping devices. Overall, the invention maximizes the full artistic and design potential of timepieces and current technologies, in contrast to existing methods of time display that are hampered in these respects by constraining structures, layouts, or modes of operation.

Furthermore, with its compressed, analog-form approach to time depiction that visually presents the advancement of time in a singular, progressive manner on the display, the invention enables, with digital displays, the incorporation of time-linked functions or information directly into the time display in a manner that is simple, efficient, and visually intuitive. In particular, it allows the time content of information to be directly linked to the presentation of time, allowing for an easy visualization of such information on the time display and, by extension, its manipulation on the display, even on small displays. There is moreover no scope for confusion regarding the standard unit of time to which such information is being linked as only one unit of time is presented within the display at any given moment.

This approach also enables, where a segment or group of segments is used, other functionalities to be embedded within the segments in the time display in a simple, uncluttered manner (e.g., telephone keypad display; slide to unlock display; display for presenting a menu of applications or options; display for presenting selected items (e.g., photos, songs); display for presenting actions taken or to be undertaken; display for presenting notifications; display indicating the occurrence of a process, task or activity, e.g., booting up or switching off of an electronic device, loading of a program, application or media file, establishing a connection to a wireless or satellite network, etc.; display for indicating the status or degree of completion of a function, process, task or activity, or more generally a proportional measurement, e.g., level of power supply).

These practical and design advantages will be enhanced as current timekeeping technology is overhauled to maximize the benefits offered by this invention. The invention will lead to the generation of a wide variety of new time display designs and timepieces, promote new methods in the presentation and manipulation of time-linked functions and information, and spur innovations in timekeeping technologies (including new display technologies and new software tools and applications linked to timekeeping), ensuring that timekeeping not only keeps pace with technology, but helps to drive its future.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

These and other features of the invention will become more apparent from the following description in which reference is made to the appended drawings wherein.

DETAILED DESCRIPTION OF THE INVENTION

Figure 1A:
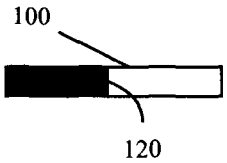
FIGS. 1A-2C present possible indicators that can be used to measure the passage of time under the invention using electronic display technologies.
Figure 1B:
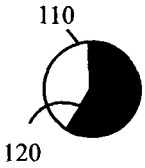

A new time display and method for presenting time information is described, where time information is shown by means of an indicator (or possible set of indicators) within a defined space, for example, by movement of an indicator through a segment or group of segments, or by such segment(s) moving in relation to a fixed indicator. Standard units of time, such as hours, minutes, and seconds, are not depicted simultaneously by means of unique indicators as with a traditional watch, where separate hands are used to indicate different standard units of time, or by the use of additional segments or sets of segments to depict each of the standard units of time, as with some watches that depict time in a linear fashion. Instead, the progression of each of the standard units of time is depicted and measured by means of an indicator within the same defined space (for instance, within the same segment or group of segments), with only one standard unit of time being displayed at any given moment. The reading of the other standard units of time is obtained by means of switching between different time "layers", "modes" or "states". Markers demarcating time intervals within the defined space may be used to facilitate the reading of time.

This integrated approach requires the user to switch between time "layers" in order to obtain a full reading of the time since each layer depicts only one standard unit of time and possible increments thereof at any given moment. The alternation between time layers is obtained through a mechanical or electronic switch (e.g., button, rotating bezel, rotating disc, sliding switch, knob, motion sensor, touch-screen, etc.), set of such switches, or other means (e.g., touch sensor, optical, heat sensitive, wireless connection, from a timer, voice or sound activation) enabling a selection of the standard unit of time to be displayed.

The ability to integrate easily the depiction of time within the same defined space is due to the convention that is used to represent time, namely that there are twelve hours in each half day, sixty minutes within each hour, and sixty seconds within each minute. With twelve and five being factors of sixty, every one-hour interval in twelve hours can be used to represent five-minute and five-second intervals. Thus, a depiction of the hours, minutes, and seconds can be performed within the same defined space (and, where they are used, within the same segment or set of segments), with precision facilitated where twelve one-hour intervals are clearly demarcated. These intervals can become five-minute and five-second intervals when the minute and second "layers" are respectively activated. In addition, with ten and six also being factors of sixty, every two-hour interval in twelve hours can be used to represent ten-minute and ten-second intervals. Other standard units of time can, furthermore, be integrated into the same time display, such as sixtieths of a second, days of the week, days of the month, weeks, months of the year, etc. Some units of time are more easily accommodated within a twelve-hour scale, such as sixtieths of a second and months. Alternatively, a twenty-four hour scale can be adopted; in this case, a two-hour interval can be used to represent five-minute and five-second intervals.

The progression of time can be depicted as the progressive motion of an indicator or group of indicators within a defined space. In this case, where segments are employed, the indicator could move as a distinct pointer (e.g., through use of a line, shape, physical arm, or other means) through each of the segments or segment ("non-cumulative" depiction of time), or involve the segments or segment being partially or fully "filled up" or otherwise indicating an accumulation of time ("cumulative" depiction of time), with the filled space or its leading edge (or other means of identifying the progression of time within the segments or segment) serving effectively as the indicator, or some combination of methods thereof. Alternatively, the indicator or set of indicators may be fixed, with the defined space (or segments if employed) changing in position relative to the indicator(s), thus serving to indicate the progression of time. A cumulative and non-cumulative approach to time depiction can be adopted in this case as well.

The progression of time may be depicted as continuous (smooth progression, with no break in motion), as discrete (block or step-wise motion by which time "rests" for a period, without motion, representing an increment of a time unit, until the period is completed and time progresses to the next unit of time), or some combination thereof. For instance, where sixty segments are used on a visual display, segments may be filled up (or, for instance, illuminated) immediately one by one, but then become unfilled (or darkened) as time moves on, reflecting a non-cumulative approach.

The technology used to display the time may be mechanical, optical or electronic (e.g., LCD, LED, plasma, "electronic ink", "electronic paper", photoelectric or similar optical output), or some combination of these and other possible means, and can be used to depict the progression of time as continuous or discrete. Although electronic displays such as LCDs and LEDs are technically discrete, they may have sufficient resolution (i.e., very small pixels) to appear to the user as being continuously variable. Many cellular telephones and other portable devices have displays with sufficient resolution that movement on their display screens would appear as continuous.

Figure 13A:
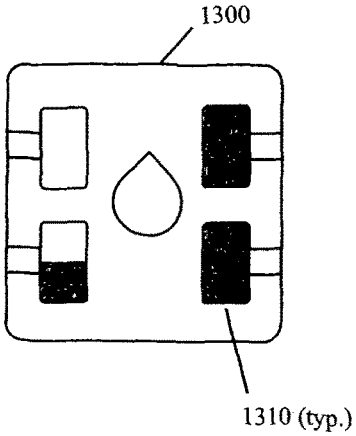
Figure 13B:
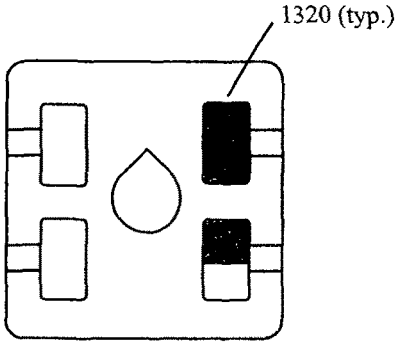
Figure 13C:
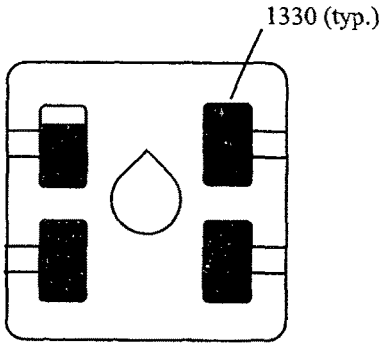
Figure 14A:
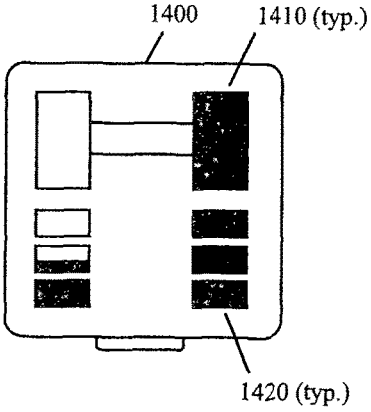
Figure 14B:
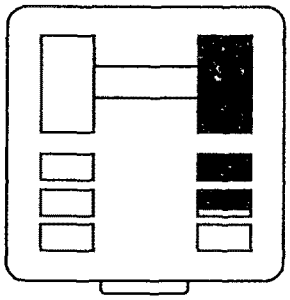
Figure 14C:
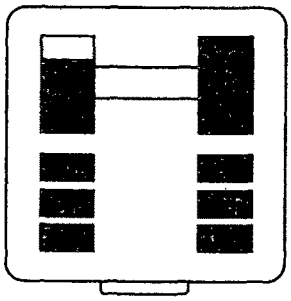
Figure 15A:
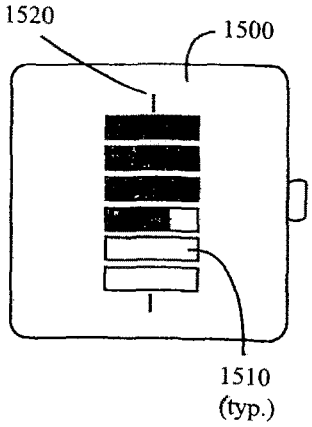
Figure 15B:
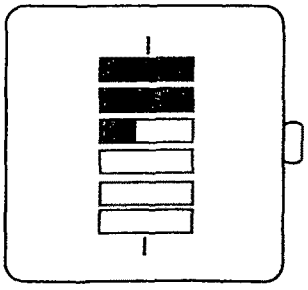
Figure 15C:
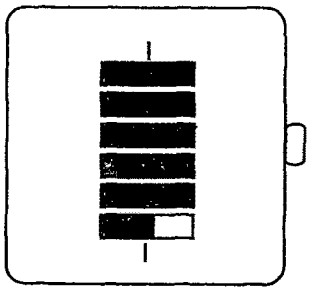

The segment or segments that may be used to depict time information on the visual display, such as 100, 110, 200, 210, and 220 in FIGS. 1A-2C, can be any shape or size and may be fixed or variable in their dimensions. Each segment may be a defined area (e.g., shape on a screen, projection on a wall) or physical display element, or some combination thereof, within a visual display. The number of segments that make up a visual display does not need to match perfectly the number of divisions or time intervals that may be used to depict the time; for instance, instead of using twelve segments to represent 12 one-hour intervals in a half a day, four segments could be employed, with 3 one-hour intervals demarcated on each segment (e.g., see FIGS. 13A-13C). The segment or segments may have a geometric shape (e.g., circle, oval, square, rectangle, triangle) or non-geometric shape (e.g., jagged line, flower petal, animal). They may change in number, shape, pattern, colour, brightness or size as time progresses. Further, the segments could move over time, for instance where the indicator is fixed, changing their position relative to the indicator as time progresses. Moreover, the segment shapes could be entirely customized by the user, possibly even as time progresses through the visual display or by means of user gestures or manipulation on the display.

Indeed, the entire visual display, including the background of the display, could be fully customized if not designed by the user. For instance, a timekeeping device could be provisioned to allow the segment or segments on the display and background of the display to be customized by allowing the user to download and store a set of images or patterns electronically, which can then be employed as segments and background for the display. The timekeeping device could be connected to a computer or other electronic device via a USB, Firewire, wireless, or similar connection, or could be connected to a local wireless network or global satellite network. An options menu could be launched when the timekeeping device is connected, providing users with options to locate and download BMP, GIF or JPG icons and/or graphic images to their timekeeping device to customize their display. Such operations and functionality are well known in the art.

Figure 2A:
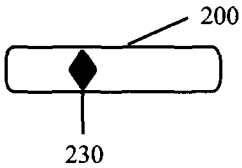
Figure 2B:
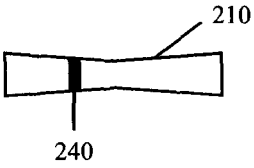
Figure 2C:
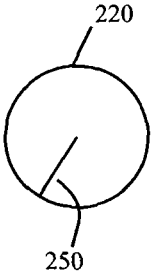

FIGS. 1A-2C also provide examples of indicators that can be used to measure the progression of time. In FIGS. 1A and 1B, the leading edge of the partially "filled" segment(s) 120 serves as the indicator for measuring the time, providing two examples 100, 110 of a "cumulative" approach to the depiction of time. In FIGS. 2A-2C, a moving, single point indicator 230, 240, 250 is used to measure the time, providing three examples 200, 210, 220 of a "non-cumulative" approach. An indicator can be a physical object; for instance, the needle 1910 in FIGS. 19A-19C serves as the indicator in the display. The segments themselves may be used as the indicator, for instance as shown in FIGS. 29A-30C and FIGS. 32A-32C, where an illuminated segment serves as the indicator. In addition, the indicator may be fixed in position, with the segments changing their position with respect to the indicator as time progresses, as shown for instance in FIG. 25 and FIGS. 57A-58C (see reference characters 2510, 5730 and 5830).

Any physical, electronic or other means can be used as an indicator insofar as it can be clearly distinguished and used to measure the passage of time. Thus, for instance, where a segment is used as the indicator, the indicator could be an illuminated segment, darkened segment, differently coloured segment, segment containing a different pattern, a slightly vibrating illuminated segment, or any other means by which the segment can be distinguished from another segment. Similarly, where a defined portion of a segment is used as an indicator, any means can be used to distinguish it as an indicator—for instance by means of a line or other type of shape, be it fixed in size or form or changing in size or form with the passage of time, or by any other means serving to distinguish the portion (e.g., differently illuminated, coloured, patterned, etc.).

The indicator could be a geometric or non-geometric shape. The shape could also be customizable; for example, the user could draw or design the shape, or the time device could be provisioned to allow the user to download and install a selected digital image, storing the image and using it as an indicator. Users can manipulate graphic images with third party applications such as Photoshop and Paint. Such images can then be stored as BMP, GIF or JPG files in an accessible location. The clock, watch or clock software then only needs to be directed to the location of the stored image in order to access it or download it. Such operations and functionality are well known in the art. Regarding a line or other type of shape, there may be a precise part of the shape that serves as the indicator, for instance the leading edge, mid-point, or end-point of the shape. Furthermore, any type of physical object could be used as an indicator insofar as it can be clearly distinguished and used to measure the passage of time. While arms and needles may serve as typical indicators, other forms of physical indicators could be used, for instance an inscribed line, inscribed shape, physical object (e.g., jewel), optical light output (e.g., LED), extrusion or cavity on an object, and other indicating means inscribed on or attached to a revolving wheel, shutter, cylinders, moving belt, train assembly, piston, drum, or other type of moving mechanical part. Naturally, indicators could take on many other different forms, such as a beam of light or projection.

A preferred embodiment of the invention is for time to be depicted through the use of one to twelve segments on the visual display so that, by means of the segments themselves and possible markers, there are twelve clearly demarcated intervals. Each interval represents one hour, five minutes, five seconds or, optionally, five sixtieths of a second, depending on which standard unit of time is selected for display. The use of twelve demarcated intervals facilitates the reading of time so that the hours, minutes, and seconds can be clearly measured using the same segments and possible markers. A switching mechanism (or group thereof) enables the user to select the unit of time to be displayed. As with the segments, the demarcated intervals do not have to be of equal physical length.

Figure 3A:
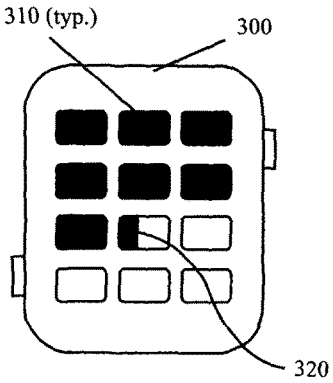
FIGS. 3A-19C present various timepiece displays in accordance with one of the preferred embodiments of the invention.
Figure 3B:
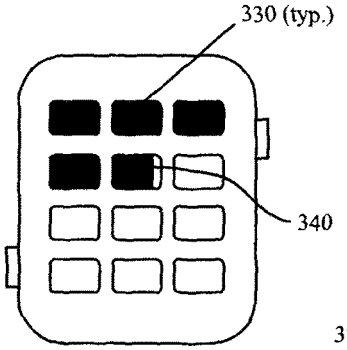
Figure 3C:
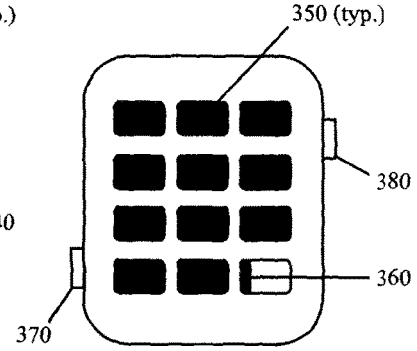

FIGS. 3A-19C provide examples of this preferred embodiment. Unless otherwise indicated, the time displayed in these Figures is 7:23:56. FIGS. 3A-3C show a single display 300 used to present three standard units of time (namely, hours, minutes, and seconds) separately and uniquely by means of the same twelve segments. FIG. 3A shows the "hours" mode, FIG. 3B the "minutes" mode, and FIG. 3C the "seconds" mode. In FIG. 3A, seven hours and a fraction thereof (specifically, 23/60 of an hour) are displayed: each filled display segment 310 represents one hour, while the partially filled display 320 represents the proportion of the eighth hour that has elapsed; in this case, segment 320 is filled proportionately with respect to twenty-three minutes (i.e., it is 23/60 filled). In FIG. 3B, each fully filled display segment 330 represents five minutes, while the partially filled display segment 340 represents the balance of three minutes, for a total of twenty-three minutes. In FIG. 3C, each fully filled display segment 350 represents five seconds, while the partially filled display segment 360 represents the balance of one second, for a total of fifty-six seconds. A user who would like to have a rough estimation of the time could glance at the hour display in FIG. 3A. If a more precise reading of time is desired, a switch (e.g., 370 <left bottom>) would need to be activated by the user (or by some other person or by an automatic mechanism) in order to display the minutes (FIG. 3B). The same switch or a separate switch (e.g., 380 <right top>) would need to be activated in order to display the seconds (FIG. 3C).

Figure 4A:
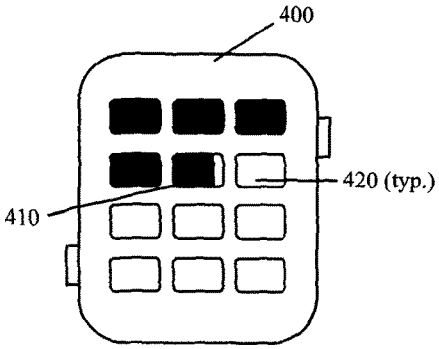
Figure 4B:
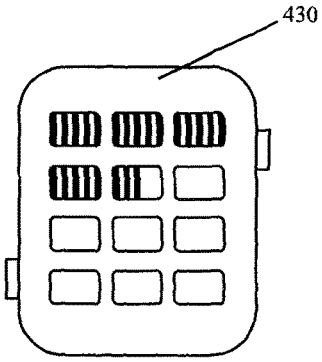
Figure 4C:
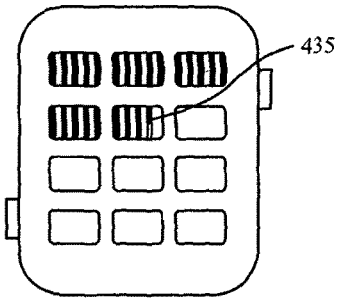

FIGS. 4A-4C show how, in the minutes display (FIG. 3B), the progression of time could be shown as continuous or discrete. In FIG. 4A, the progression of time through the display 400 is shown as continuous, with the leading edge of the space filling up 410 serving as the indicator and moving smoothly through segments 420. The progression of time could instead be shown in a discrete manner, as in FIG. 4B; in display 430, only full increments of each passing minute are shown. The depiction of time as discrete is assisted by the use of markers within the segments—namely empty lines placed between each of the relevant increments of time within each segment—so that each minute increment is clearly seen. FIG. 4C is similar to FIG. 4B except that a continuous approach is adopted. Each vertical bar, representing a minute, is filled continuously as time passes (for illustrative purposes, FIG. 4C indicates a slightly different time; roughly twenty-three and a half minutes are shown as having elapsed). Bar 435 is being filled from top to bottom though it could be filled in the opposite direction.

Figure 5:
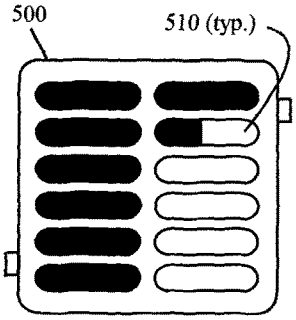
Figure 6:
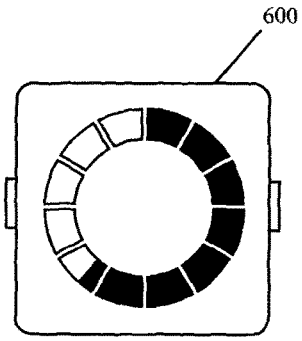
Figure 7:
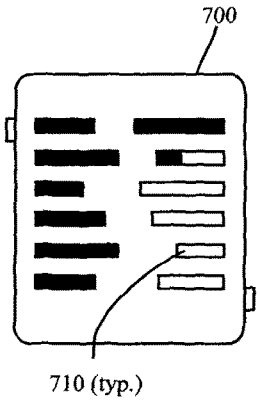

FIGS. 5, 6 and 7 present examples of similar embodiments. These Figures, as presented, display the hours and each of the twelve segments represents an hour time interval. As can be seen, the segments can be any shape or size and do not necessarily need to be uniform even if each segment might represent the same length of time. With no need to use separate sets of segments to present each of the standard units of time, a clean and uncluttered visual display is obtained, with scope for the segments to be arranged in any fashion such as linear, curvilinear, circular, etc. In FIG. 5, the display 500 uses twelve segments 510, organized in a two by six grid. Although this grid is completely different from the traditional watch display, the user would have no difficulty adjusting to such a presentation of time. The display 600 of FIG. 6 uses twelve curved LCD or LED segments 610, providing an appearance not unlike that of a traditional analog watch. The display 700 of FIG. 7 uses a two by six grid like that of FIG. 5, except that the segments 710 are of varying sizes. Again, there is no difficulty with this presentation, provided that the user appreciates that each segment represents the same interval of time.

FIGS. 8, 9, 10, 11, 12A and 12B provide additional examples of similar embodiments. These Figures, as presented, display the hours and, as before, each segment in these Figures represents an hour time interval.

Figure 8:
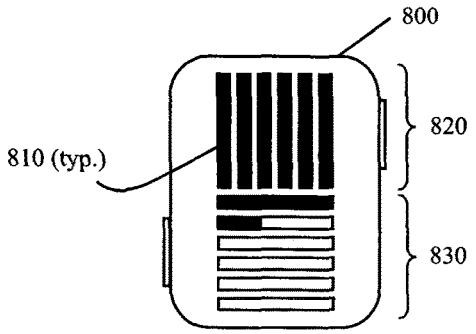

In the timepiece 800 of FIG. 8, twelve segments 810 are employed, with time depicted in a progressive, cumulative fashion, first through the six upper vertical segments 820 and then through the six lower horizontal segments 830.

Figure 9:
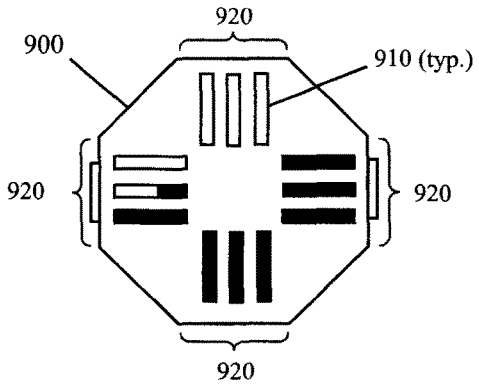

In the timepiece 900 of FIG. 9, twelve display segments 910 are filled in a cumulative manner, the segments being arranged in groups of three 920. The depiction of the hours begins in the block of segments 920 to the middle right, with each segment being filled in an outwards direction toward the perimeter of the display.

Figure 10:
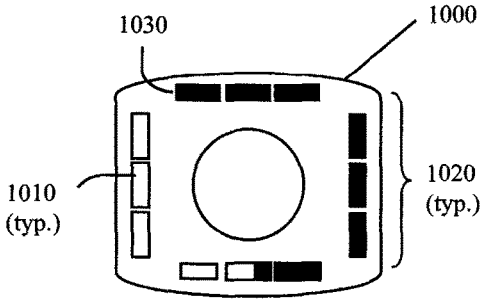

FIG. 10 shows a time display 1000 using twelve segments 1010 arranged in groups of three 1020. The depiction of the hours starts on the top row 1030, at the leftmost segment. The hours progress in a cumulative, clockwise manner through the segments.

Figure 11:
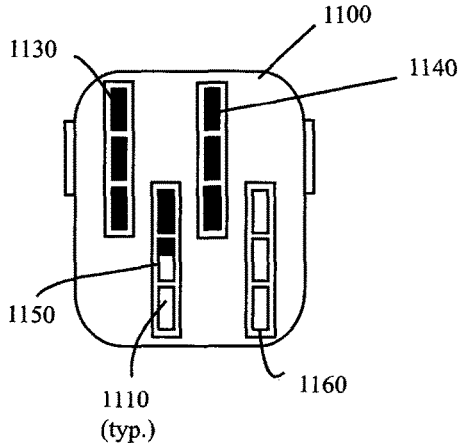

The display 1100 in FIG. 11 uses twelve segments 1110 arranged in vertically arranged groups of three 1130, 1140, 1150, 1160. The hours progress in a cumulative, downwards manner, starting with the first group of segments 1130. The depiction of the hours then proceeds through successive groups of segments 1140, 1150, and 1160.

Figure 12A:
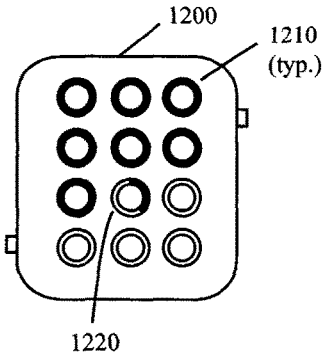

FIG. 12A shows a display 1200 with twelve segments 1210 in annular form. The progression of the hours is depicted in a cumulative manner, moving across each row of segments from left to right, starting at the top row of display 1200 and moving downwards. The progression of time through each annular segment starts at the top of the ring and moves clockwise through the ring, as shown in partially filled segment 1220.

Figure 12B:
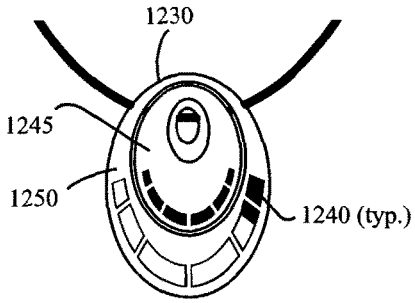

FIG. 12B shows a pendant where the time display 1230 is fully integrated into its design, using twelve segments 1240 of unequal size and dissimilar shape yet nonetheless conforming to a well-laid out and easily understood design. This Figure shows how the invention can facilitate miniaturization, permitting the integration of timekeeping into small objects such as jewellery given its economical use of space and simplicity. Time progresses in cumulative manner, starting in the inner pendant piece 1245, at the top right, moving leftwards through the segments, and then shifting to the outside piece 1250. The switch that permits the user to select the standard unit of time to be displayed could be in the form of a button placed at the back of the pendant (not shown).

Figure 12C:
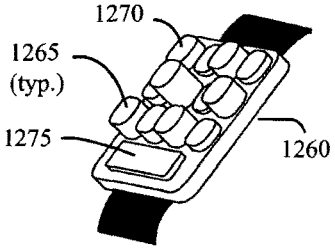

FIG. 12C shows a wristwatch 1260 that embodies the invention in a three-dimensional manner. It contains twelve segments 1265 of different heights. The time is not presented in this Figure, but the depiction of the hours could start in segment 1270. The button 1275 enables the user to switch between the standard units of time. The time could be depicted two dimensionally across the top of each of the projecting segments and/or three dimensionally, for instance with time being depicted as moving up the sides of each of the segments, or by means of revolving around the sides of the segments.

FIGS. 13A-18C provide examples of embodiments where fewer than twelve segments are employed. Twelve intervals are nonetheless clearly demarcated using markers that are placed on the edges of, or through, the segments. In display 1300 of FIGS. 13A-13C, four segments 1310, 1320, 1330 are used to depict the time, with markers demarcating three one-hour intervals on each segment 1310 in FIG. 13A ("hours" mode), three five-minute intervals on each segment 1320 in FIG. 13B ("minutes" mode), and three five-second intervals on each segment 1330 in FIG. 13C ("seconds" mode). FIGS. 14A-14C show a time display 1400 where the length of the segments 1410 and 1420 are not uniform; however, the markers clearly demarcate twelve intervals, allowing for a precise reading of the hours in FIG. 14A, minutes in FIG. 14B, and seconds in FIG. 14C. FIGS. 15A-15C show a time display 1500 with six segments 1510 of uniform size, intersected by a marker 1520 cutting vertically through the segments 1510 that serves to create twelve intervals of time. FIG. 15A depicts the hours, FIG. 15B the minutes, and FIG. 15C the seconds.

Figure 16A:
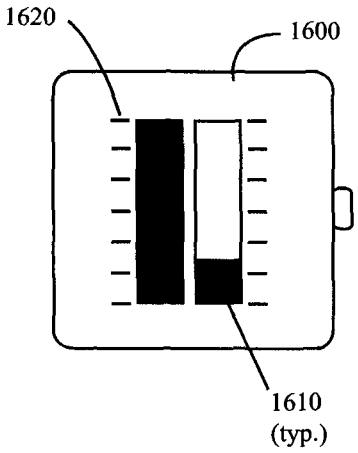
Figure 16B:
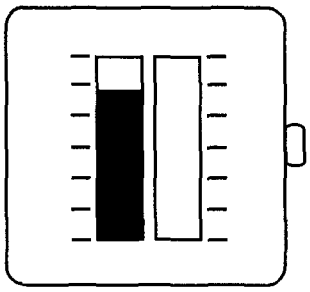
Figure 16C:
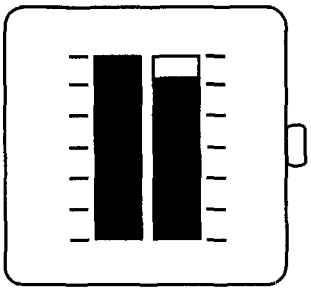
Figure 16D:
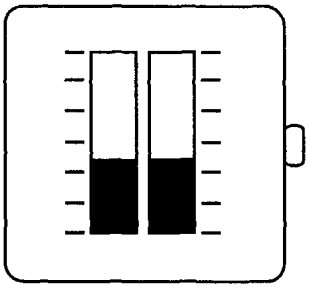

In the time display 1600 shown in FIGS. 16A-16C only two segments 1610 are used, but sufficient markers 1620 are used to display twelve intervals. In FIGS. 16A-16C, the progression of time is read starting with the left segment, from the bottom to the top, and then moving to the right segment, from the bottom to the top. FIG. 16A depicts the hours, FIG. 16B the minutes, and FIG. 16C the seconds. FIG. 16D illustrates an alternative display for the minutes, in which the markers no longer represent five-minute intervals but rather ten-minute intervals. While the use of one segment would be adequate to present the minutes, two segments are, for aesthetic reasons, used, with the progression of the minutes shown in both segments in identical fashion. FIG. 16D illustrates how, under the invention, the number of segments and time value assigned to the demarcated intervals might change or be changed, for instance upon switching between the standard units of time or selecting a new display option.

Figure 17A:
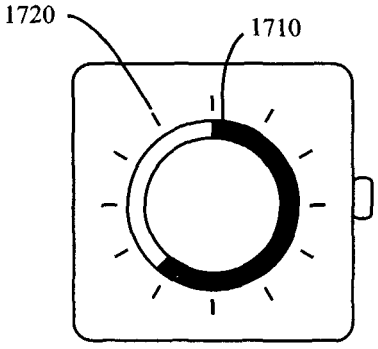
Figure 17B:
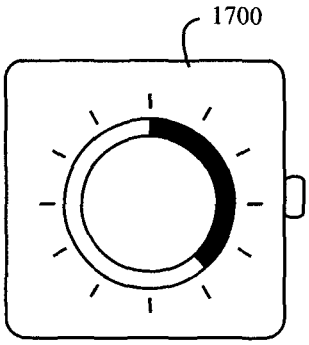
Figure 17C:
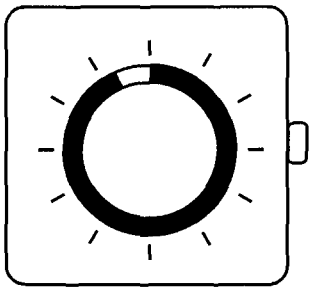
Figure 18A:
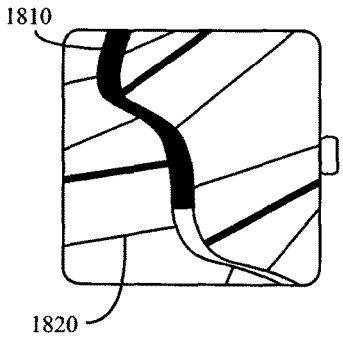
Figure 18B:
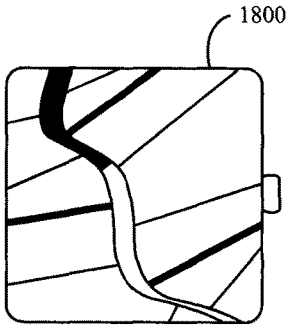
Figure 18C:
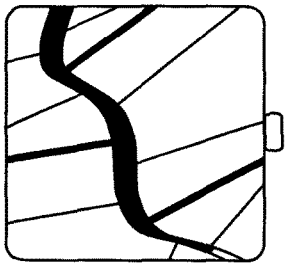

In the displays 1700, 1800 of FIGS. 17A-17C and FIGS. 18A-18C, only one segment 1710, 1810 is used. FIGS. 17A-17C adopt the same approach to the depiction of time as FIG. 6, except that twelve intervals are established through the use of markers 1720 instead of twelve segments. FIG. 17A depicts the hours, FIG. 17B the minutes, and FIG. 17C the seconds. FIGS. 18A-18C show the enhanced design potential offered by the invention, namely the scope for elaborating unencumbered, flexible, and innovative display layouts that are at the same time simple to understand. FIG. 18A depicts the hours, FIG. 18B the minutes, and FIG. 18C the seconds.

Where a mechanical approach is adopted as an embodiment, each display segment may be a physical "groove" or "slot" permitting the movement of an indicator or arm within it (such as a rotating barrel-type indicator, for example) or across it (e.g., as an arm sliding across it, perpendicular to the groove or slot and fastened to a motor underneath). Alternatively, a segment or group of segments may be inscribed using lines, geometric objects, or representational spaces with markers denoting appropriate intervals, but with a mechanical indicator or set of indicators capable of moving across the rendered segments. Furthermore, the indicator (or possible set of indicators) may be fixed, with the display itself or the segment or set of segments within it shifting in relation to the indicator, thus indicating the progression of time. In this case, the movement of the display or the segment(s) within it would need to be enabled by some mechanism or set of mechanisms. Various electro-mechanical components could be used to implement such displays, including for example servo-motors, stepper motors, solenoids, electro-magnetic coils and the like. Such mechanisms would be well known to a person skilled in the art.

Figure 19A:
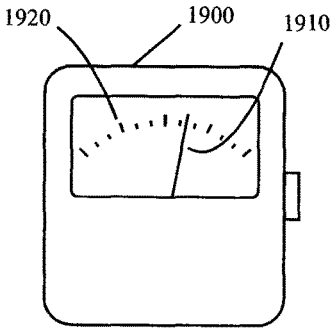
Figure 19B:
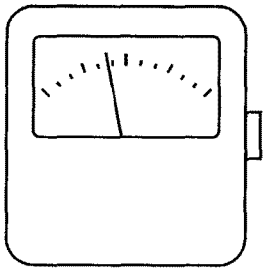
Figure 19C:
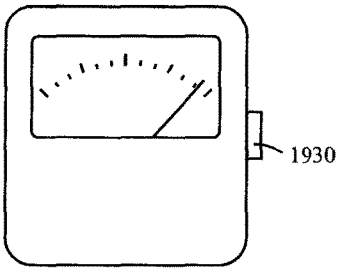

FIGS. 19A-19C provide an example of a mechanical embodiment 1900. The display seeks to imitate a voltage meter. The time is indicated on display 1900 by means of a single needle-like arm 1910 and the demarcated intervals 1920 appearing in the display. By pressing the pushbutton 1930 on the right hand side, the user can switch between the hours in FIG. 19A, minutes in FIG. 19B, and seconds in FIG. 19C. The single arm 1910 serving as the indicator could be perpetually depicting the time; however, to conserve energy and reflect the "voltage meter" concept, the single arm 1910 could normally be at rest unless activated by the user seeking to read the time. The single arm 1910 could be actuated using an electro-magnetic coil in the same manner as a voltage meter or could rely on a servo-motor or stepper motor as previously described.

Figure 20:
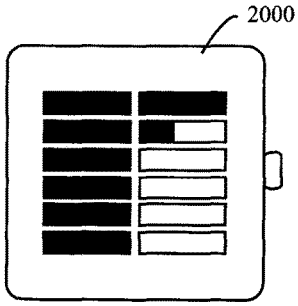
FIGS. 20-25 provide examples of how the progression of time could be depicted under various embodiments of the invention based on the nature of the indicator.
Figure 21:
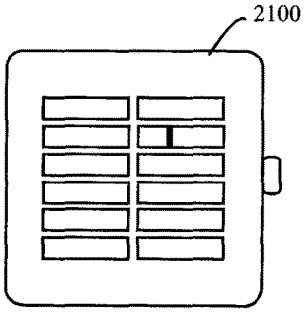
Figure 22:
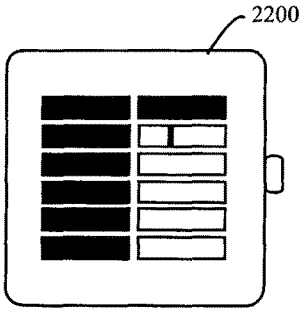
Figure 23:
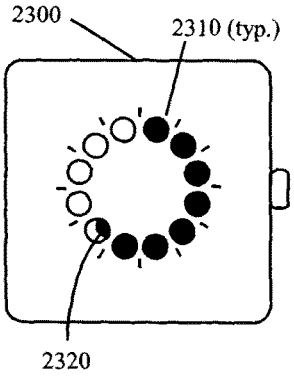

FIGS. 20-25 provide examples of how the progression of time could be depicted under various embodiments of the invention based on the nature of the indicator. These figures display the time 7:23:56 and, for illustrative purposes, depict solely the hours display. The display 2000 in FIG. 20 employs an indicator that moves continuously and, being the leading edge of a progressively filled segment, depicts time in cumulative fashion, whereas the display 2100 in FIG. 21 employs a point indicator that also moves continuously but, with no backfilling of the segment, depicts time in non-cumulative fashion. FIG. 21 may have alternatively depicted time in a cumulative fashion, but with backfilling only taking place within the segment within which the indicator is present. The display 2200 in FIG. 22 employs both of these types of indicators, thus combining cumulative and non-cumulative approaches: the former for the segments within which time has already fully elapsed, the latter for the segment within which time is currently elapsing. The time as depicted in FIGS. 20-22 could appear on the same time-keeping device; the type of indicator and method of time depiction to be adopted could be programmable, allowing the user to select any one of these and other modes as the default position, or change the order in which the segments are filled. The display 2300 of FIG. 23 comprises an indicator that moves continuously but non-linearly, with the indicator rotating through each circular segment 2310 and progressively creating, in cumulative fashion, a filled pie-chart as shown in segment 2320.

Figure 24:
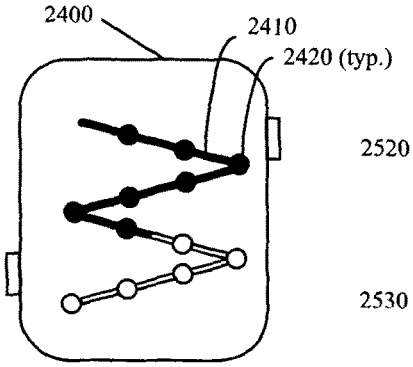

In the display 2400 of FIG. 24, the indicator moves though a grouping of linked linear and ball-shaped segments. The indicator moves downwards in continuous, cumulative fashion along linear segment 2410 within an M-shaped path except that, upon reaching the end of each interval demarcated by a ball-shaped segment 2420, a discontinuity is introduced; the indicator suddenly becomes fully discrete, fully activating the ball-shaped segment. The indicator thereupon moves onwards along the linear segment.

Figure 25:
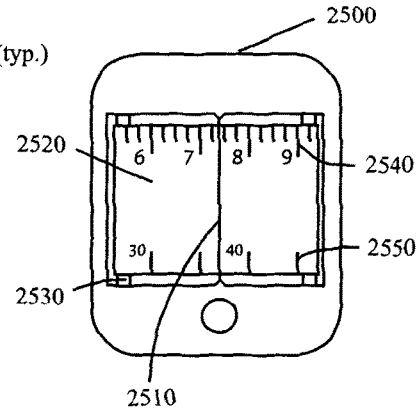

In the display 2500 of FIG. 25, the indicator 2510 is fixed in position. The indicator, a thin metal bar, is placed across a leftward-moving belt, single segment 2520, that is driven by rotating cylinders 2530. Markers 2540 are inscribed on one side of the moving belt in order to permit a reading of the hours, while separate markers 2550 are inscribed on the other, side of the belt to permit a reading of the minutes and seconds. The revolving segment, with its markers, shifts in position relative to the fixed indicator 2510, thus depicting the progression of time. Switching between the hours, minutes, and seconds on this display would alter the speed of the belt and most likely cause a shift in its position as the new standard unit of time is displayed. The belt could be manipulated, for example, using a servo-motor, stepper motor or similar electro-mechanical device. The timepiece could conceivably allow the user to shift the fixed indicator to a different location within segment 2520. The belt would need to shift to reflect this new position of the indicator.

Figure 26:
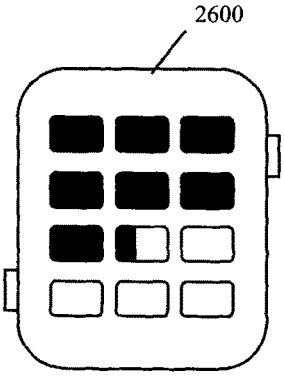
FIGS. 26-28 illustrate the difference between the depiction of time as continuous and as discrete, in accordance with one of the preferred embodiments of the invention.
Figure 27:
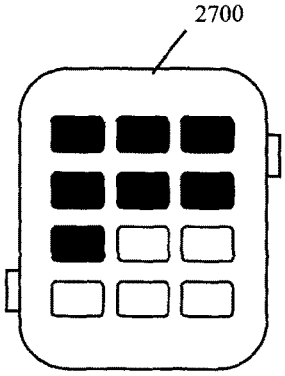
Figure 28:
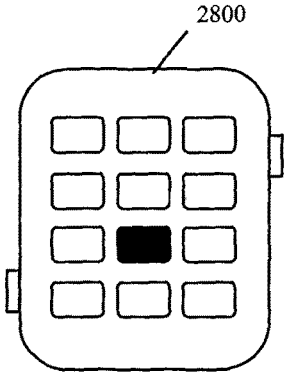

FIGS. 26-28 illustrate the difference between depicting time as continuous and time as discrete. These Figures indicate 7:23:56 as the time and display the hours. The progression of the hours in the display 2600 in FIG. 26 is shown as continuous, while the progression of the hours in the display 2700 of FIG. 27 is fully discrete. A discrete approach is maintained in the display 2800 of FIG. 28, similar to FIG. 27, except that a non-cumulative approach to the depiction of time is adopted and the placement of the hours has been shifted one segment ahead in comparison to the case in FIG. 27 to indicate that the time is moving through the interval bounded by seven and eight o'clock. The placement of the hours could have followed the approach found in FIG. 27. The choice of location for the hour could be an option for the user.

Another embodiment of this invention involves the depiction of time through the use of sixty segments, with appropriately placed markers so that twelve clearly demarcated intervals are presented. Under this embodiment, a demarcated set of five segments represents one hour in the hours layer, while each individual segment represents, in the minutes layer, one minute and, in the seconds layer, one second. The use of twelve demarcated intervals facilitates the reading of time so that the hours, minutes, and seconds can be easily measured using the same segments and markers. A switching mechanism (or group thereof) enables to the user to select the standard unit of time to be displayed.

Examples of this embodiment are shown in FIGS. 29A-32C with the displayed time being 7:23:56 unless otherwise noted. Sixty segments are used to depict the progression of time; however, markers are used in FIGS. 29A-31C to facilitate the reading of time. The markers may be integrated into the design of the display and thus may not be simple line marks. The exact time is obtained by switching between the hours, minutes, and seconds and measuring the progression of time across the sixty segments.

Figure 29A:
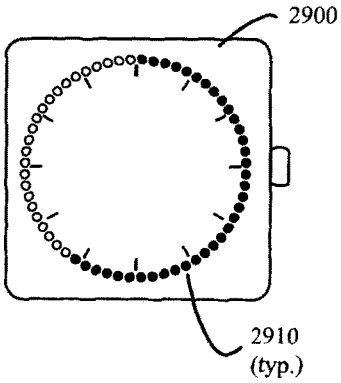
FIGS. 29A-32C present various timepiece displays employing sixty segments, in accordance with an embodiment of the invention.
Figure 29B:
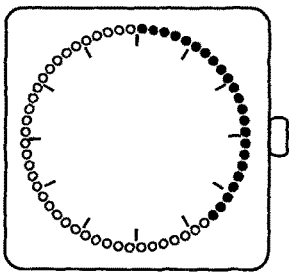
Figure 29C:
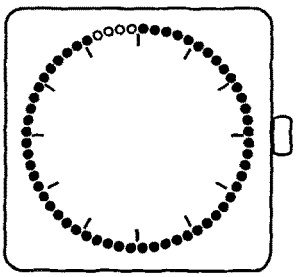

The display 2900 of FIGS. 29A-29C shows a "semi-discrete" implementation, with the progression of time shown in a cumulative manner. Specifically, in FIG. 29A, fractions of the hour ($^{12}/_{60}{}^{ths}$ or $^{1}/_{5}{}^{th}$ of an hour) are depicted in increments, namely by each segment 2910, in progressive and sequential order, being immediately and fully filled up upon completion of twelve minutes within the hour. The progression of the minutes in FIG. 29B involves each segment 2910, in progressive and sequential order, being immediately and fully filled up as each minute passes; the same process would apply to the progression of the seconds in FIG. 29C.

Figure 30A:
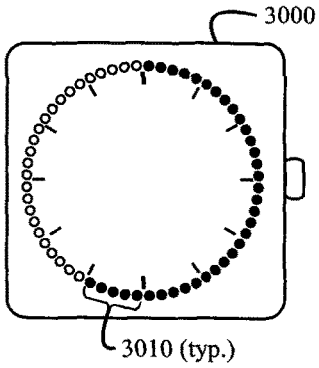
Figure 30B:
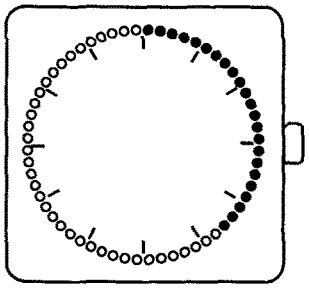
Figure 30C:
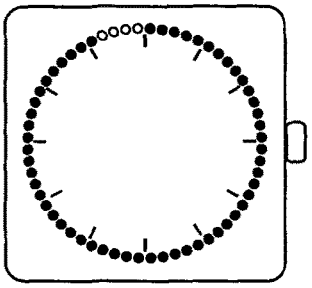
Figure 31A:
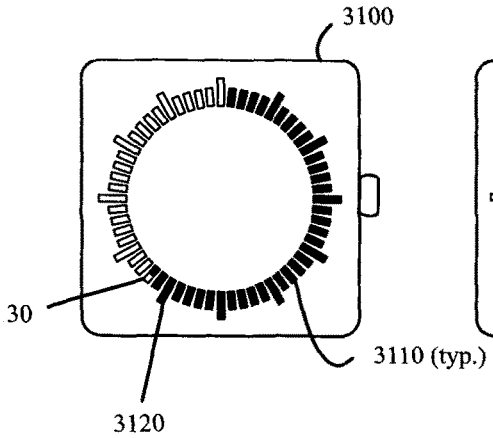
Figure 31B:
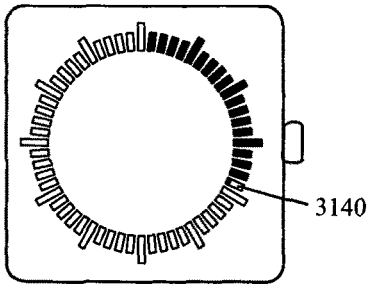
Figure 31C:
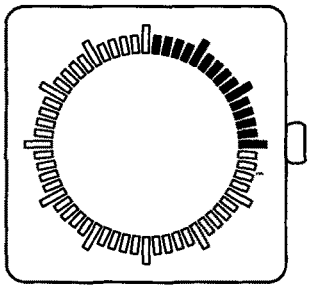

The display 3000 of FIGS. 30A-30C shows a "fully discrete" implementation. In FIG. 30A, for example, the progression of the hours is depicted fully discretely, that is, the hour "advances" only when the full hour is complete and, when this happens, five segments 3010 immediately fill up, given that each segment within grouping 3010 represents $1/5^{th}$ of an hour in the hours layer. The progression of minutes in FIG. 30B and seconds in FIG. 30C is similar to FIGS. 29B and 29C.

An example a "continuous" approach in the sixty-segment embodiment described earlier is shown in the display 3100 of FIGS. 31A-31C. The time indicated is 7:18:15. While there are sixty segments 3110, the longer segments serve effectively as markers to demarcate twelve intervals on the time display. In the hours display in FIG. 31A, the progression of the hours is depicted by means of a cumulative, continuous filling up of each segment 3110, with each segment 3110 representing $1/5^{th}$ of an hour. Seven hours are shown by the filled segments through the seven intervals, with a seven-hour marker 3120. The next segment beside it (having a value of twelve minutes) is also filled, while 6/12ths of the next segment 3130 is partially filled, indicating that eighteen minutes have elapsed within the seventh hour. In the minutes display FIG. 31B, the progression of the minutes is depicted in the same way as the progression of the hours in FIG. 31A, except that each segment 3110 now represents one minute. The minutes display shows that eighteen minutes have elapsed as eighteen segments have been filled up. The partially filled segment 3140 indicates that an additional fraction of a minute—specifically, 15/60ths or $1/4^{th}$ of a minute—has also elapsed. The depiction of seconds in FIG. 31C could be continuous, with fractions of seconds being depicted in a manner similar to the depiction of fractions of minutes in FIG. 31B; alternatively, the progression of seconds could be fully discrete, with each segment 3110 being filled, immediately and in full, only upon the completion of the relevant second. The latter approach is adopted in FIG. 31C.

Figure 32A:
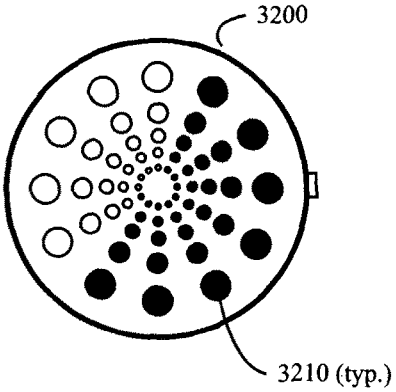
Figure 32B:
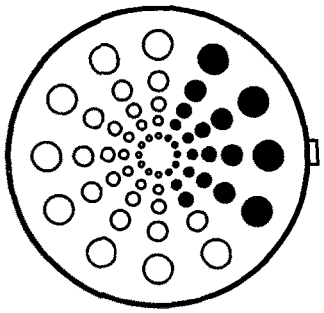
Figure 32C:
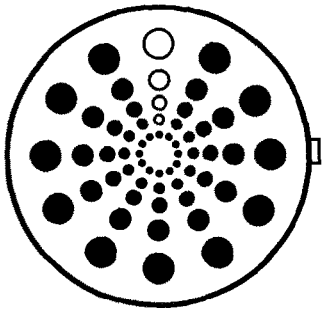

The display of FIGS. 32A-32C is similar to the display of FIGS. 29A-29C in that a semi-discrete, cumulative approach is adopted within a sixty-segment display, except that the design for the display 3200 is now very different each of the sixty segments 3210 is arranged in radial fashion, with twelve groups of five segments radiating outwards from the centre of circular display 3200. Twelve intervals are effectively demarcated by this grouped arrangement of sixty segments 3210. The progression of time starts at the centre, moving outwards toward the perimeter along the first group of five segments, arranged in alignment with, and pointing toward, what would be the one o'clock position on a traditional analog timepiece. Upon completion of the first hour, the progression of time re-starts at the centre and moves again in the direction of the perimeter, within the second group of five segments, and so on until the twelfth hour is completed. The minutes and seconds are depicted in FIGS. 32B and 32C, respectively, with each circular segment representing one minute in FIG. 32B and one second in FIG. 32C. While a cumulative, semi-discrete approach is adopted for the hours in FIGS. 32A-32C, a non-cumulative and more fully discrete approach could be adopted whereby the passage of the hours in FIG. 32A is depicted simply by means of each of the circular segments on the edge of the display 3200 being filled or illuminated during the relevant hour.

The embodiments outlined above (FIGS. 3A-32C) describe the invention where the progression of the standard units of time is inscribed within or across the same segment or set of segments, with the activation of a switch or set of switches permitting each of the standard units of time to be displayed. These embodiments seek to maintain a level of precision in timekeeping by ensuring that twelve intervals of time are clearly demarcated, whether by use of the segments themselves or possible markers. A wide variety of other embodiments are possible by the nature of the invention. For instance, one can consider embodiments that provide a lower or higher level of precision in timekeeping; for instance, the number of demarcated intervals could be reduced to one or possibly none or, alternatively, could be increased to sixty. FIGS. 33A-37C provide examples where fewer than twelve demarcated intervals are used. These Figures depict the time as 7:23:56. Given the importance of at least knowing the hour, these particular embodiments depict the progression of the hours fully discretely, which facilitates the reading of this standard unit of time. By contrast, FIGS. 38A-38C, described below, provide an example where more than twelve demarcated intervals are chosen—in this case sixty.

Figure 33A:
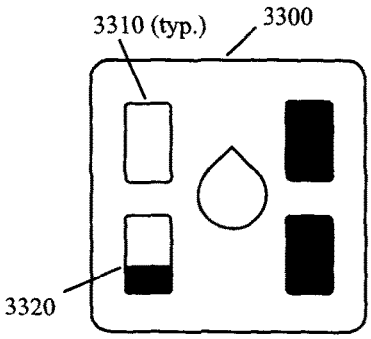
FIGS. 33A-37C present various timepiece displays employing less than twelve demarcated intervals and involving the discrete depiction of the hours, in accordance with an embodiment of the invention.
Figure 33B:
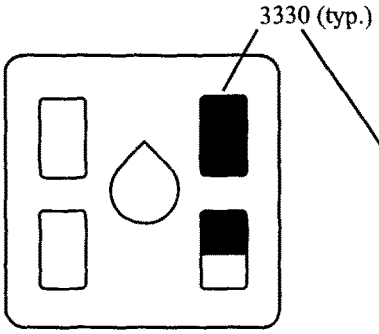
Figure 33C:
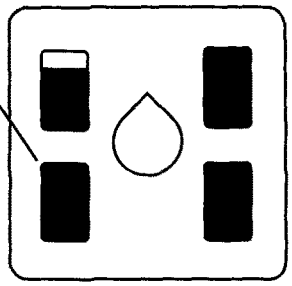
Figure 34A:
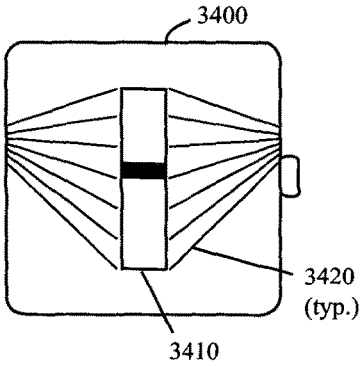
Figure 34B:
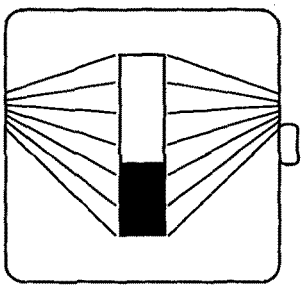
Figure 34C:
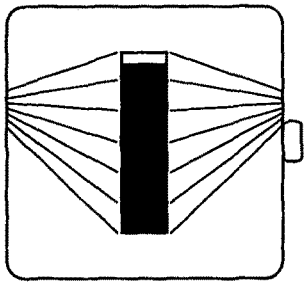
Figure 35A:
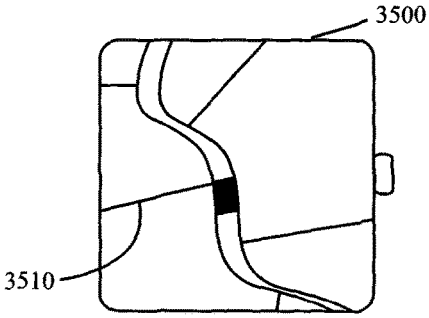
Figure 35B:
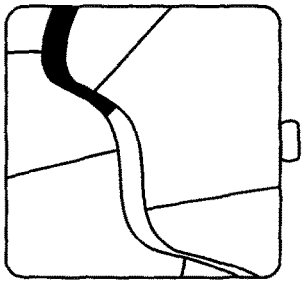
Figure 35C:
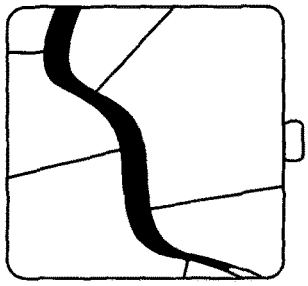
Figure 36A:
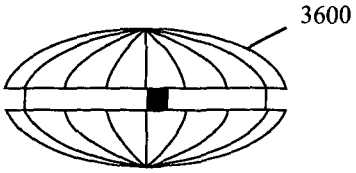
Figure 36B:
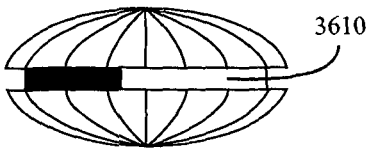
Figure 36C:
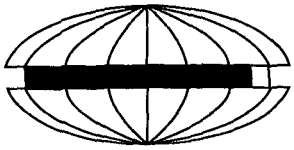
Figure 37A:
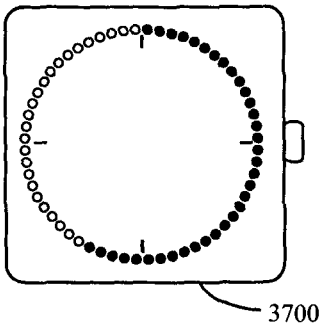
Figure 37B:
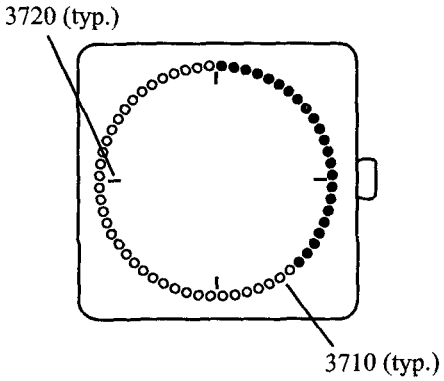
Figure 37C:
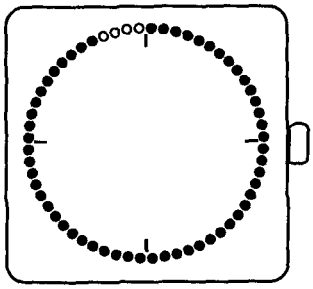

In FIGS. 33A-33C, the time display 3300 has four segments of uniform size 3310 which serve to demarcate four intervals of time, each interval being three hours in the hours display in FIG. 33A. The hours are depicted discretely, by the step-wise movement of indicator 3320, which could be placed as shown or one increment ahead. If the movement of the hours in FIG. 33A were instead depicted as continuous, similar to the depiction of the minutes in FIG. 33B and seconds in FIG. 33C through segments 3330, it might be difficult to read the hours. FIGS. 34A-36C show the versatility of the invention; with the same number of segments (one), very different design layouts are possible. The display 3400 in FIGS. 34A-34C uses one vertical segment 3410, with time progressing from the bottom of the segment 3410 to the top, with markers 3420 on both sides demarcating two-hour intervals in FIG. 34A (or ten-minute intervals in FIG. 34B and ten-second intervals in FIG. 34C). The display 3500 in FIGS. 35A-35C is similar to display 1800 in FIGS. 18A-18C except that fewer markers 3510 are used, leading to a cleaner display. FIGS. 36A-36C show a clam-shaped timepiece 3600 where the time is not read from the face of the timepiece 3600, but rather from its edge. It could be worn as a pendant on a necklace or be a pocket watch. The time progresses through single segment 3610. The switch enabling the user to read each of the units of time (hours in FIG. 36A, minutes in FIG. 36B, and seconds in FIG. 36C) could be the clam shell itself, acting as a button. FIGS. 37A-37C show a time display 3700 using sixty segments 3710, with the progression of time shown as in FIGS. 30A-30C, but with only four intervals demarcated by markers 3720. Precision in the depiction of the minutes (FIG. 37B) and seconds (FIG. 37C) is maintained given the use of sixty segments 3710, although readability is lessened in comparison with FIGS. 30A-30C as fewer markers are used.

Figure 38A:
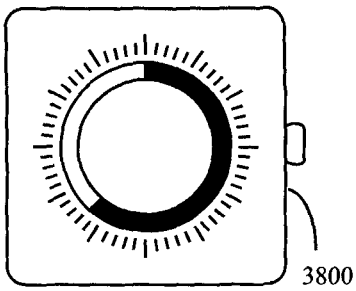
FIGS. 38A-38C present a timepiece display employing sixty demarcated intervals, in accordance with an embodiment of the invention.
Figure 38B:
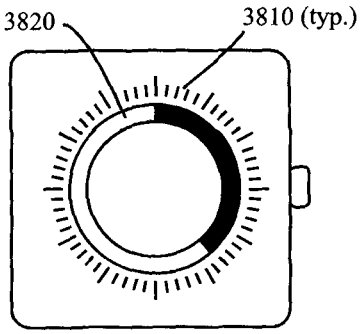
Figure 38C:
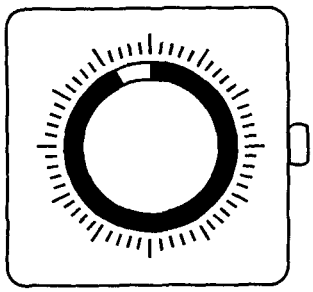

FIGS. 38A-38C provide an example of how the number of demarcated intervals 3810 could exceed twelve, in this case sixty. The Figures indicate a time of 7:23:56. The display 3800 is similar to a sixty-segment display, except that one segment 3820 and sixty markers 3810 are used instead, establishing sixty demarcated intervals. Time progresses through the sixty intervals in a cumulative, clockwise manner, similar to FIGS. 29A-29C, starting at the twelve o'clock position. However, the progression of time is shown as continuous instead of semi-discrete; this is made possible by the fact that the display 3800 comprises just one segment 3820. FIG. 38A shows the hours, FIG. 38B shows the minutes, and FIG. 38C the seconds.

Another embodiment of the invention excludes one of the standard units of time from its ambit—in particular the hours—and involves an integrated depiction of the minutes, seconds and, optionally, sixtieths of a second through one to twelve segments so that, through the use of segments and possible markers, six or twelve clearly demarcated intervals are presented. The use of six or twelve intervals facilitates the reading of time as it is customary to think of minutes and seconds in increments of five or ten. This embodiment is similar to the embodiments described in FIGS. 3A-32C except switching is performed between minutes and seconds (and, optionally, sixtieths of a second), with the hours depicted separately by means of a different display, time display method, or timekeeping device.

FIGS. 39A-45 provide examples of this embodiment. The displayed time is 7:23:56 unless otherwise noted. In FIGS. 39A-41B, the hours are depicted in digital numeric format 3910. Alongside this depiction of the hours, the displays in FIGS. 39A-41B depict the progression of the minutes and seconds in continuous, cumulative fashion through the same segment or set of segments, with the user able to alternate between the minutes and seconds layers by activating a switch, namely a pushbutton 3930. There is no relationship between the depiction of the hours and depiction of the minutes and seconds.

Figure 39A:
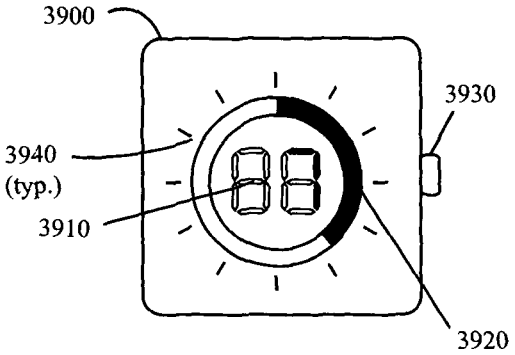
FIGS. 39A-46B present various timepiece displays where switching is performed only between minutes and seconds, in accordance with an embodiment of the invention.
Figure 39B:
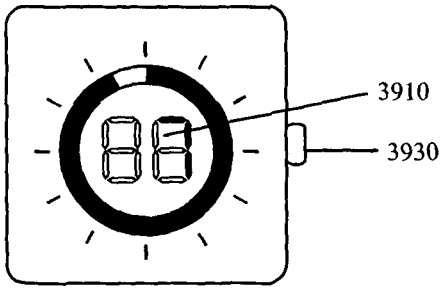

Specifically, the display 3900 of FIG. 39A presents the hours in a digital numeric display 3910 and the minutes in a circular display 3920, with twelve demarcated intervals established by means of markers 3940 and each interval comprising five minutes (or, in the seconds mode, five seconds). Actuating the pushbutton 3930 causes the circular display 3920 to display the seconds as shown in FIG. 39B.

Figure 40A:
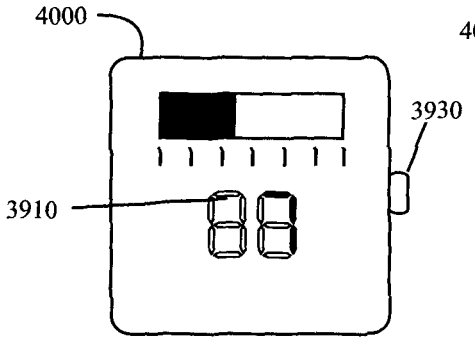
Figure 40B:
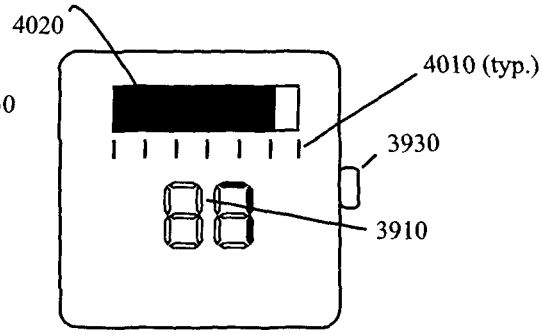
Figure 41A:
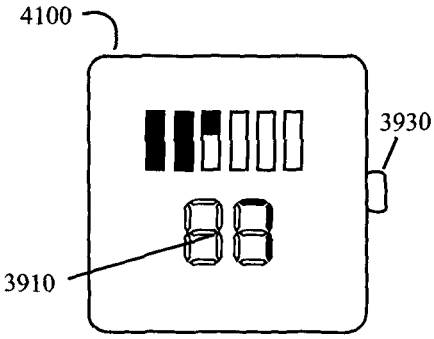
Figure 41B:
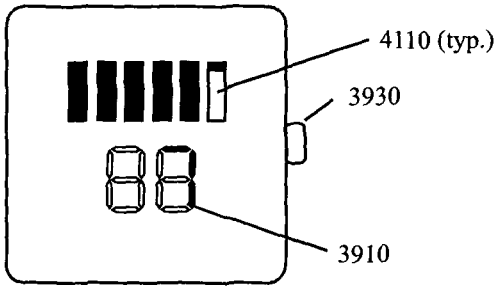

FIGS. 40A-41B provide examples of displays 4000, 4100 that contain six demarcated intervals, with each interval comprising ten minutes in the minutes layer or ten seconds in the seconds layer. In FIGS. 40A-40B, one segment 4020 along with seven markers 4010 demarcate six intervals (with FIG. 40A depicting the minutes, FIG. 40B the seconds), whereas in FIGS. 41A-41B the six segments 4110 themselves demarcate six intervals (with FIG. 41A depicting the minutes, FIG. 41B the seconds).

Figure 42A:
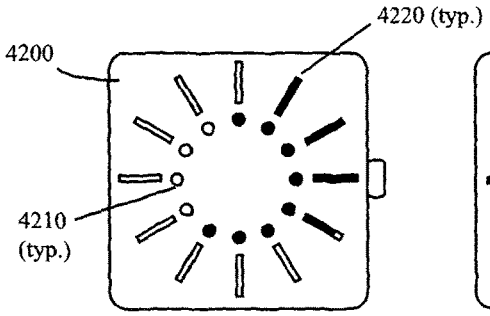
Figure 42B:
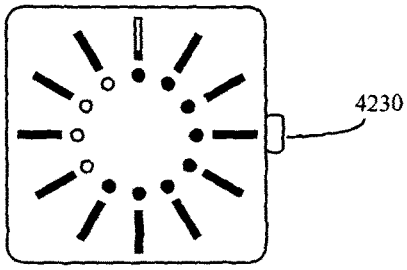
Figure 43A:
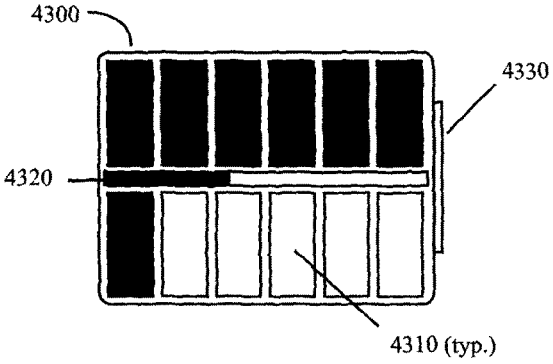
Figure 43B:
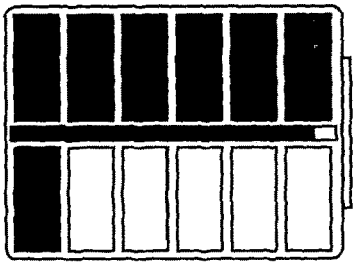

In the display 4200 of FIGS. 42A-42B, the hours are depicted by means of twelve circular segments 4210, whereas the minutes and seconds are depicted using twelve bar segments 4220. Actuating the switch 4230 allows the user to alternate between the display of minutes in FIG. 42A and seconds in FIG. 42B.

Additional examples of this embodiment are shown in FIGS. 43A-44B. In display 4300, twelve segments 4310 are used to present the hours, with the segments discretely filled in a left to right pattern, starting with the upper row. Independently of this display of the hours, the minutes and seconds are presented using a single bar segment 4320, with six intervals demarcated by means of markers implicitly introduced by alignment of the segment 4320 with the hours segments 4310, thus establishing intervals of ten minutes in FIG. 43A and ten seconds in FIG. 43B. The exact time is obtained by reading the hours and switching between the minutes and seconds by means of a switch or interface 4330. This design is easily amenable to miniaturization and could be implemented, for example, on a ring. The hours segments 4310 could be translucent jewels, with an optical output placed beneath each jewel to illuminate it when appropriate.

Figure 44A:
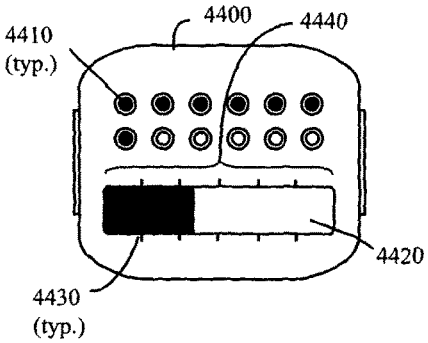
Figure 44B:
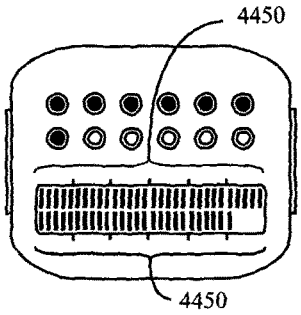

In the display 4400 of FIGS. 44A-44B, the hours are presented separately using twelve discrete display segments 4410. FIG. 44A depicts the minutes by means of one segment 4420 with markers 4430 placed alongside the segment 4420, with six demarcated intervals 4440 of ten minutes each. FIG. 44B presents the seconds differently; it transforms, using the same segment 4420 and set of markers 4430, the aforementioned six intervals into twelve intervals 4450, with the markers on each side of the segment 4420 now demarcating distinct intervals. Within these twelve demarcated intervals of five seconds each, the passage of the seconds is shown discretely.

Figure 45:
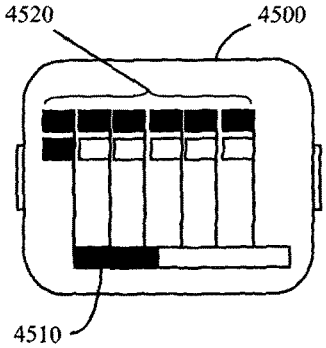

FIG. 45 provides another example of how minutes and seconds could be displayed on segment 4510, in combination with a separate hours display 4520. The design elements in display 4500 provides markers for demarcating intervals on segment 4510.

A further embodiment of this invention involves an integrated depiction of the minutes, seconds and, optionally, sixtieths of a second through the use of sixty segments, with appropriately placed markers to demarcate six or twelve intervals. Each segment represents one minute in the minutes layer and one second in the seconds layer. The hours are depicted entirely separately by means of a separate display, time display method, or timekeeping device. As with the previously described embodiment, the use of six or twelve demarcated intervals facilitates the reading of time.

Figure 46A:
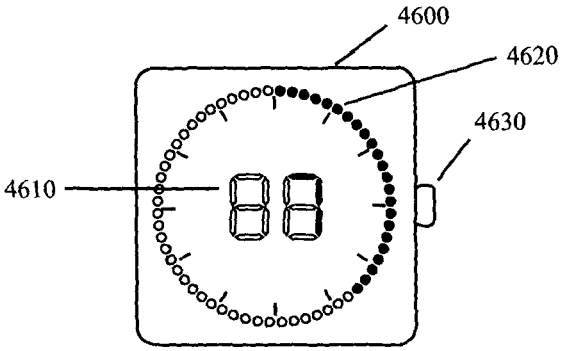
Figure 46B:
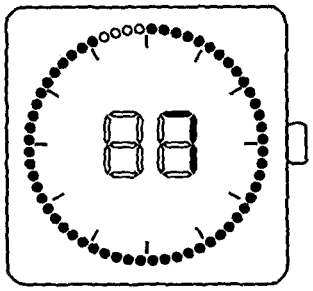

For instance, in FIGS. 46A-46B, the time of 7:23:56 is indicated on display 4600, with the hours presented in digital numeric format 4610 and constituting a distinct display within general display 4600. The minutes and seconds are depicted using a single sixty-segment display 4620, the user alternating between the minutes and seconds displays with a switch 4630 or other type of user interface. Markers demarcate every fifth segment in the sixty-segment display 4620 to show five-minute intervals in the minutes display (FIG. 46A) and five-second intervals in the seconds display (FIG. 46B).

Stopwatches and countdown timers as well as other types of timer functions could easily be produced with the same displays and user interfaces as described herein. The only difference between a stopwatch and a regular timepiece is that it can be set to zero or a preset value and will monitor the passage of time from that point. Conversely, a countdown timer may be preset to a given time and will count down from that time; alternatively, the countdown timer could start counting down from the current time for a duration matching a preset interval of time. Other types of timer functions could be introduced, for instance the monitoring of the passage of time over a preset or otherwise defined interval of time, starting from zero or a preset or defined value (e.g., length of an audio recording, song, video, task or activity, etc.; expected duration for the loading of a program, application, audio recording, song, or video; expected time for the completion of a task or activity, etc.). To enable these timer functions, it may be necessary to provide additional input controls for the user, but this is easily done given the description of the invention herein. The operation of timer functions could potentially be automatic, subject to modalities specified by a pre-selection, or be linked to the operation of a separate activity, process or functionality, such as connection to a specific wireless network, arrival at a location, performance of a task, loading of a program, application, song or video.

Figure 47:
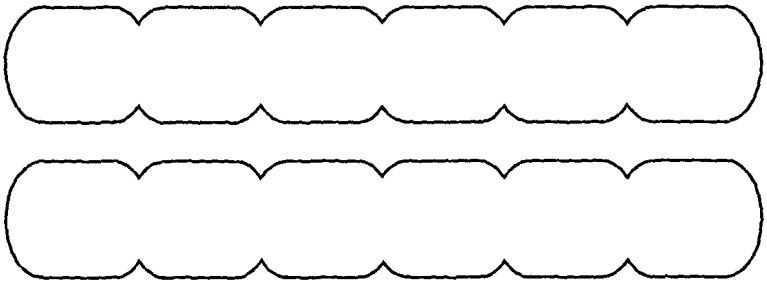
FIGS. 47 and 48 present possible shapes of segments that also provide markers for time intervals, in accordance with an embodiment of the invention.
Figure 48:
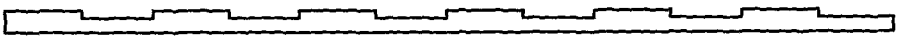

The embodiments described above make frequent reference to markers. Markers serve as reference points to facilitate the reading of time by demarcating intervals of time, enhancing precision in the measurement of time. These markers may be located on, beside, or within (e.g., by means of a separating space such as a line) any segments that are employed, and may include nearby reference points (e.g., decorative pointers or lines) that are not necessarily adjoined to or within the segments but are placed such that they effectively serve as markers. The shape, size, and location of markers may change or be changed, for instance as time progresses, as the user switches between the standard units of time, or upon selection by the user as an option. The shape of any employed segments (e.g., segments with "bumps" or "points") or their shape, size, or positioning relative to other segments (e.g., some segments being bigger or standing out in same way, such as every fifth segment in a set of sixty segments) may effectively introduce markers. FIG. 47 provides an example of markers being introduced by way of indents within two segments, thereby demarcating twelve intervals of time. FIG. 48 provides an example of elevated surfaces serving as markers to demarcate twelve intervals of time. That is, the user may see or feel the physical indentations in the display segments of FIGS. 47 and 48, the physical indentations marking the divisions between the values of time.

Furthermore, in the embodiments described above, other time information could be incorporated into the displays. For instance, by means of a switch, it could be possible to display the passage of the months. The display of months would be best suited for those embodiments that have twelve demarcated intervals of time; in such embodiments, the passage of time through the twelve astrological signs could be depicted as well. The days within a month could also be included as a standard unit of time for display. In addition, AM and PM could be indicated by means of illumination, shading, pattern or colouring of any employed segments, or by some other means; for instance, two colours could be used on an LCD display (e.g., with one colour used for the indicator), with the colours reversing when AM moves to PM. Brightness level could also be used to distinguish between AM and PM, with for instance a brighter display level being used during PM hours and a dimmer display level being used during AM hours. Moreover, there may be an indicator on the timepiece serving to show which standard unit of time is being displayed; alternatively, different brightness levels, patterning, colouring, shape, size, or shading of the indicator or any employed segments (particularly if an electronic display technology is used), or other means could be used to denote the different time layers. For the purpose of an alarm function, markers could be introduced, as determined by the user, into the display in order to identify the alarm time(s). Also, as explained below, with embodiments employing computer software and digital displays, a broad array of time-linked functions and information could easily be embedded in the time display, allowing for an integrated visualization of time and time-linked functions and information (see FIGS. 59A-62D).

Figure 49:
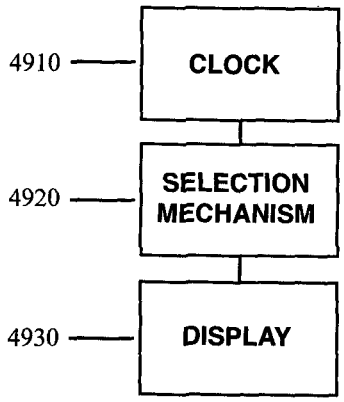
FIGS. 49 and 50 present block diagrams of functional mechanisms for implementing embodiments of the invention.
Figure 50:
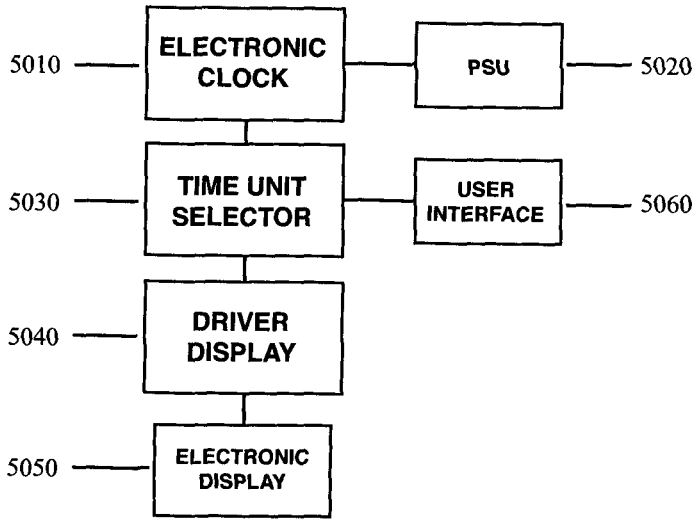

Examples of functional implementations of the invention are presented in FIGS. 49 and 50.

As shown in the overview of FIG. 49, the system comprises basically some manner of clock 4910 for keeping track of the passage of time in standard units of hours, minutes, seconds, and optionally sixtieths of a second. The clock 4910 keeps track of the current time but may also keep track of calendar information such as year, month and date, timer data (e.g., stopwatch, countdown), and more. The clock 4910 may be mechanical or electronic. Electronic clocks are typically implemented as ASICs (application specific integrated circuits), that is, electronic devices which are dedicated to a specific purpose and have all of the functionality for a certain implementation on a single integrated circuit. ASICs are the implementation of choice for small electronic devices, while other implementations (typically larger implementations) may use more discrete components such as microcontrollers, DSPs (digital signal processors) and the like.

The selection mechanism 4920 of FIG. 49 is used to display the separate time units maintained by the clock 4910. As explained herein, the invention displays only one standard unit of time at a time within a visual display, so that the selection mechanism 4920 must determine which time unit to display, and direct that time unit to the display 4930. The selection mechanism 4920 may step through the time units in a predetermined order and arrangement, or in response to control inputs from the user.

The display unit 4930 may be, for example, electronic, optical or mechanical. Electronic displays may include LCD (liquid crystal display), LED (light emitting diode) display, "electronic ink", "electronic paper", plasma, or similar displays. Larger electronic displays may also include, for example, neon lights, spotlights, floodlights, and fluorescent lights. Mechanical displays may include the movement of a mechanical indicator or arm, rotating barrel-type indicator, an arm sliding across a marker system, or similar system.

FIG. 50 presents a block diagram of an exemplary electronic system for implementing embodiments of the invention.

Like the implementation in FIG. 49 above, the timekeeping mechanism or clock 5010 will keep track of the passage of time in standard units of hours, minutes, and seconds, along with other possible units such as sixtieths of a second. The clock 5010 keeps track of the current time but may also keep track of calendar information such as year, month, and date; stopwatch, countdown, and other timer data; etc. In the case of a wristwatch or similarly small device, the clock 5010 will typically be implemented, as an ASIC, dedicated to the specific watch design and having all of the desired functionality. In the same way as FIG. 49, larger implementations may use more discrete components such as microcontrollers and the like.

As an electronic device, the ASIC will need a source of power. The power supply unit (PSU) 5020 in a portable electronic device will typically be a battery and/or solar cell. In larger portable devices, external power packs may be used to convert automobile, house or office power to suit the device.

In an electronic implementation, the time unit selector 5030 of FIG. 50 will typically be implemented with the electronic clock 5010 as part of an ASIC. As described above, the embodiments of the invention display only one standard unit of time at a time within a visual display, so that the time unit selector 5030 must determine which standard time unit to display, and direct that time unit to the display driver 5040. The time unit selector 5030 may step through the standard units of time in a predetermined order and arrangement, or in response to control inputs from the user.

The selected standard units of time will be fed to the display driver 5040, which is designed to operate the electronic display 5050. An electronic display unit 5050 may include LCD (liquid crystal display), LED (light emitting diode) display, plasma, or similar displays. Larger electronic displays may also include, for example, neon lights, spotlights, floodlights, and fluorescent lights.

The electronic display unit 5050 will be determined largely by the nature of the device's design. The display driver 5040, in turn, will be designed to accommodate the electronic display unit 5050 that is chosen.

The user selects the desired standard unit of time to display via the user interface 5060. As described above, this user interface 5060 may comprise a tactile device or a non-tactile device. A tactile device may include, for example, a pushbutton, sliding switch, roller switch, knob, rotating bezel, rotating disc, toggle switch, flip switch, swivel switch, pull switch, touchscreen, capacitive touch sensor or the like. Non-tactile interfaces may include infrared sensor, optical sensor, motion detector (e.g., ultrasonic motion detector, gyroscope motion detector, etc.), voice or sound control system, wireless connection, or similar interface.

Time devices of the types described herein could also be embodied in computer software and presented on digital displays of personal computers (PCs), personal digital assistants (PDAs), smartphones, iPhones, iPads, iPods, electronic wristwatches or smartwatches, electronic jewellery (e.g., ring, necklace, bracelet), equipment employing time displays, and the like, using the operating systems and computer processors of these devices. A person skilled in the art would have no difficulty modifying existing timing/clock software to provide the user interfaces and functionality described herein. Similarly, a person skilled in the art would have no difficulty using existing technology to embody the invention in large panel displays, projections on a wall, sculptures, holograms, etc.

The use of computer software and digital displays would exploit the design flexibility offered by this invention, especially if coupled with touchscreen displays, which would facilitate switching between time layers and the manipulation of the display. With such technology, any segment or group of segments used to enable the presentation of time information on the display could, unhindered by physical constraints, take any shape or form and quickly change or be changed; for instance, segments might change in shape or size with the passage of time, as standard units of time are switched, upon selection by the user of a new display option, or by means of a user gesture directed at the segments. The number of segments or their arrangement might also change, for instance at pre-selected time periods (e.g., AM and PM), as standard units of time are switched, or upon selection of a new display option. Moreover, this invention, when coupled with computer software and digital displays (particularly touchscreen displays), facilitates the incorporation of time-linked information into the time display and its subsequent manipulation on the display, given that it provides for an economic use of space on the display and allows for the time content of information to be directly linked to the presentation of time. With such technologies, the invention also enables other functionalities to be embedded within the display—in particular within any segment(s) used for the time display in a simple, uncluttered manner, thus allowing the time display design to be used for other purposes.

Figure 51:
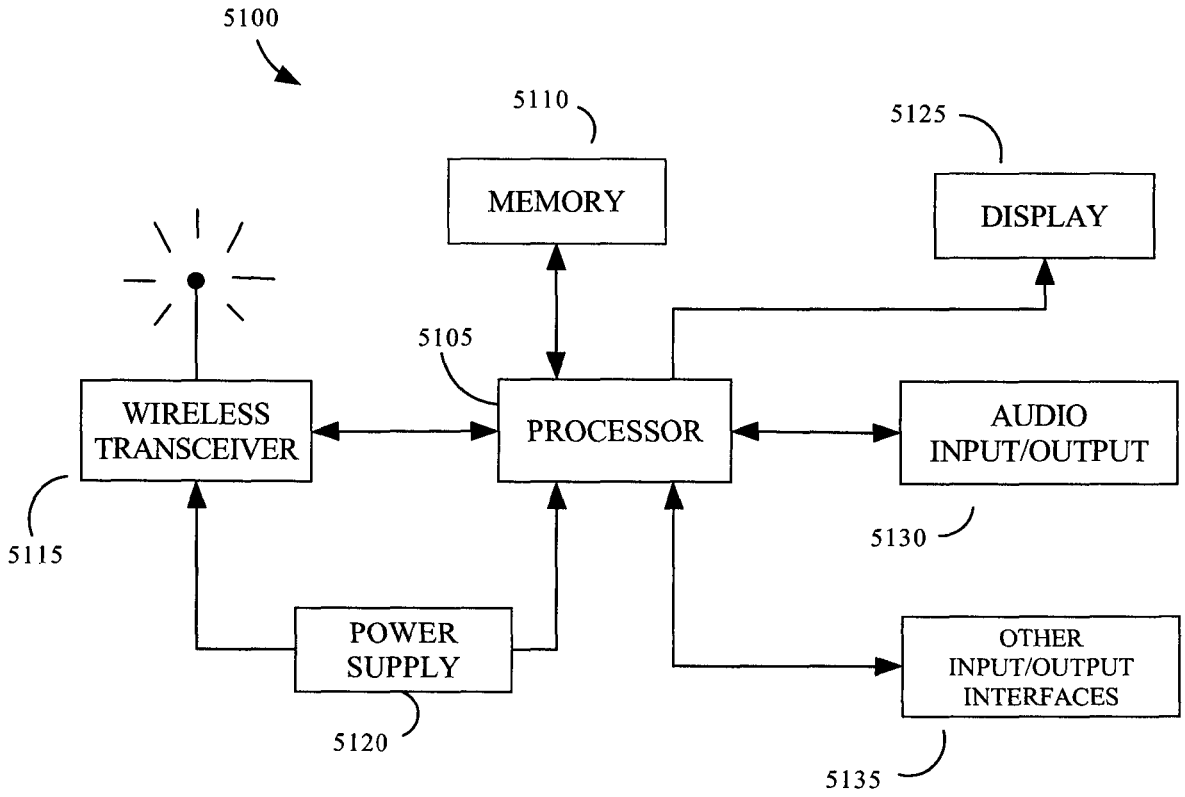
FIG. 51 presents a block diagram of a multi-purpose electronic device or system which may incorporate the invention.

A block diagram of a multi-purpose electronic device or system 5100 which could incorporate the invention is presented in FIG. 51. As noted above, such a device may include a personal computer (PC), personal digital assistant (PDA), smartphone, iPhone, iPad, iPod, electronic wristwatches or smartwatches, electronic jewellery, equipment with a time display, or the like.

Such a device or system 5100 will typically contain one or more processors or microprocessors, such as a central processing unit (CPU) 5105. The CPU 5105 performs arithmetic calculations and control functions to execute software stored in a memory 5110. In some devices the CPU 5105 may be better described as a digital signal processor (DSP) or application-specific integrated circuit (ASIC). The memory 5110 will typically comprise a combination of volatile and non-volatile memory including for example random access memory (RAM), read only memory (ROM), and FLASH memory. The memory 5110 may also include, for example, mass memory storage, hard disk drives, floppy disk drives, magnetic tape drives, compact disk drives, program cartridges and cartridge interfaces such as that found in video game devices, removable memory chips such as EPROM, or PROM, or similar storage media as known in the art. The memory 5110 may be physically internal to the device or system 5100, or physically external.

The device or system 5100 will typically include a number of different input and output interfaces 5125, 5130, 5135, depending on the general application of the device or system. In the case of an iPod, for example, a display 5125 may be included, which comprises a touchscreen as an input interface. Software programming of the iPod display and touchscreen is easily done via the iPod API (application programming interface). Smartphones and other smart electronic devices will typically include an audio input and output interface 5130 via a speaker and microphone combination, headset, earplug or Bluetooth headset. Other input and output interfaces 5135 and peripherals may also be included such as a keyboard, modem, USB connection, Ethernet card, printer, wireless or satellite connection, global positioning system (GPS), etc.

The device or system 5100 will typically include means for allowing computer programs or other instructions to be loaded or data transferred. Such means can include, for example, a wireless communications transceiver 5115 which allows software and data to be transferred between the device or system 5100 and external networks and systems. Software applications such as that of the invention and of applications based on the invention may, for example, be downloaded over the Internet via an 'app store' or similar website. Furthermore, time-linked information such as messages, notifications, songs, photos, videos, GPS-positioning, progress made with defined tasks or activities, occurrence of an event, etc. may be relayed to the device or system, which would allow such information to be presented directly within the time display.

The components of the device or system 5100 will be powered to the extent required, by a power supply 5115 of some kind. On a portable or mobile device the power supply 5115 will typically comprise a battery and charger system. On a fixed system such as a PC, this will typically comprise an AC power converting system.

A touchscreen display would provide a very convenient way of interacting with the visual display of the invention. Users could, for instance, touch, tap on (or double tap on), or swipe (e.g., up or down), the display in order to switch the standard unit of time being displayed. Also, different display options could be presented, for instance, upon swiping the display in a specific (or separate) direction (e.g., left or right), allowing the user to scroll between alternative display options (for all of the standard units of time as a whole or for a particular standard unit), which may be preset, downloaded, or customized by the user. In fact, in some embodiments the user may alter the number, shape, size, or arrangement of the displayed segment or segments as time progresses in the display, for instance by pressing down on the relevant segment(s) and making various movements with his or her finger(s); for instance, the user might decide to elongate or twist the segment in which the indicator is present, with the indicator shifting to the appropriate position within the newly altered segment in order to maintain accurate timekeeping. Similar manipulations could be made to the indicator(s). Moreover, the user may introduce or remove markers through a separate motion (e.g., two fingers swiping downward to introduce markers, or upwards, to remove the markers), allowing the user to decide when a more precise reading of time is desired. In addition, in some embodiments the user may "freeze" time in order to obtain a better reading, for instance by pressing down on the display and maintaining pressure; upon release of this pressure, the indicator could jump ahead and resume timekeeping. Similarly, in order to obtain a better reading of time, the user may magnify the display by a user gesture, for instance by the spreading of two fingers pressed on the display; the display could be de-magnified by a separate gesture, in this example by a pinching of fingers on the display. A user may also be able to insert an alarm time directly into the display simply by introducing a distinctive marker into the display, for instance by means of a particular swiping motion on the display. Naturally, other means of interaction with the touchscreen display could be envisaged to ensure these and other possible functionalities, such as through a pen-type device, motion sensor, voice control, etc.

Figure 52:
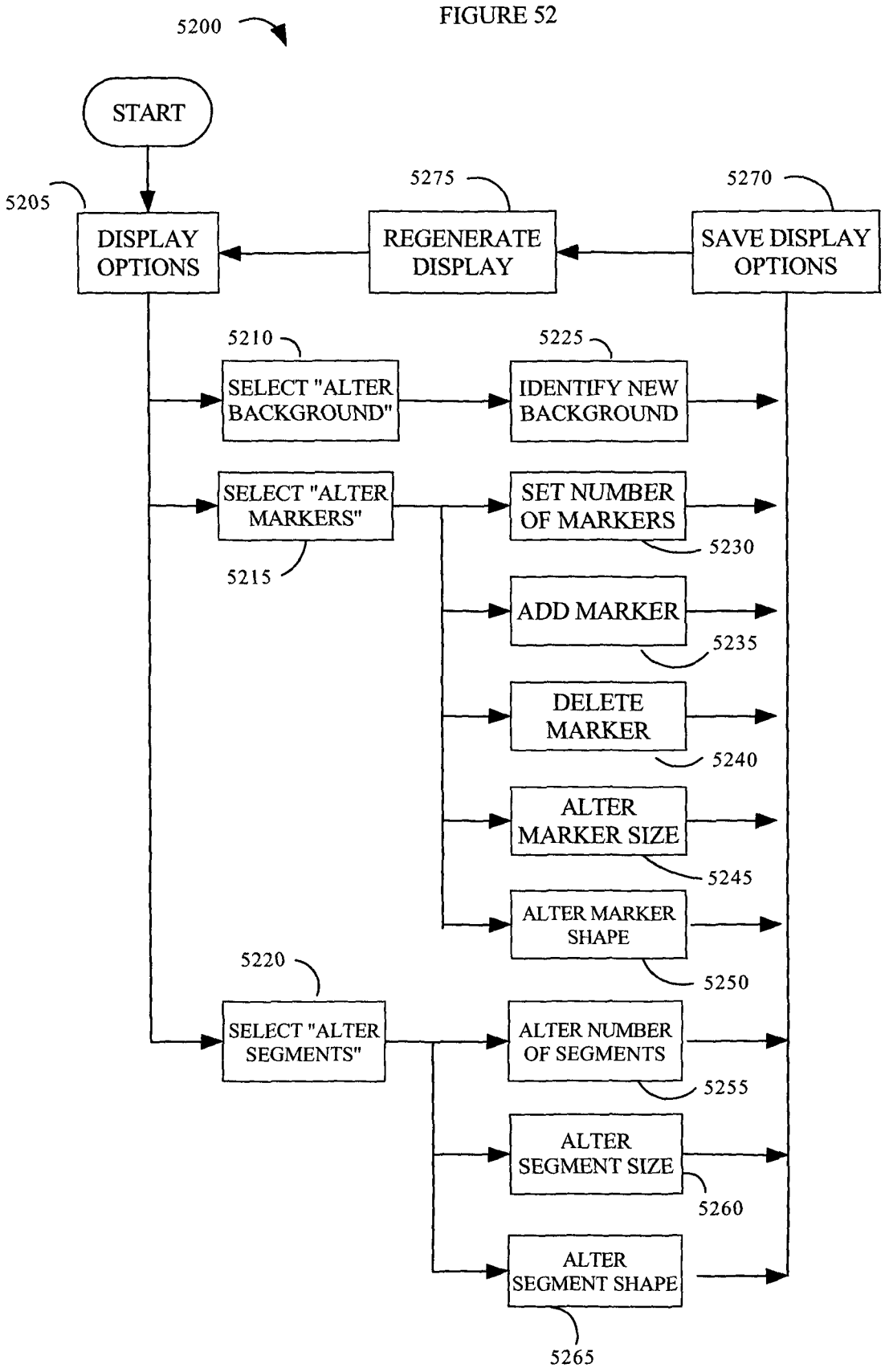
FIG. 52 presents a flow chart of an exemplary software system for implementing the invention.

An exemplary method 5200 of effecting such a software system is shown in the flow chart of FIG. 52. For example, a home page 5205 could provide a set of radio buttons or menu tabs, or a pull-down menu could be provided with selections for "alter background" 5210, "alter markers" 5215 and "alter segments" 5220.

The "alter background" 5210 selection could allow the user to identify a new background 5225 from a set of previously stored backgrounds, allow the user to download and install his/her own background, in much the same way that wallpaper and screensavers are loaded onto PCs, or allow the user to create or manipulate the background through electronic drawing tools supplied by the software system or application.

The "alter markers" 5215 selection could allow the user to manipulate the markers in many ways, including the following:

- changing the number of markers appearing on the display 5230, either by selecting from a number of pre-set values or entering a specific value chosen by the user;
- adding a marker to a specific location 5235;
- removing a marker from a specific location 5240;
- altering a marker's size 5245; or
- altering a marker's shape 5250. This could be done by selecting a shape from a provided set, downloading a personalized bitmap or other image, or enabling direct user creation or manipulation of the shape on the touchscreen.

Similarly, the "alter segments" 5220 selection could allow the user to manipulate the segments in many ways, including the following:

- changing the number of segments appearing on the display 5255, either by selecting from a number of pre-set values (e.g., 1, 2, 3, 4, 6, 12, 24, 60, etc.) or entering a specific value chosen by the user;
- altering a segment's size 5260; or
- altering a segment's shape 5265. This could be done by selecting a shape from a provided set, downloading a personalized bitmap or other image, or enabling direct user creation or manipulation of the shape on the touchscreen.

While not depicted in FIG. 52, an additional selection option could be introduced under the "alter segments" 5220 selection that would allow the user to alter the arrangement of the segments on the display. Moreover, a separate set of selection options could be introduced that would enable the user to manipulate the indicator, for instance in regard to the number of indicators and their shape, size, and arrangement.

Once the selections are made, they are saved on the system 5270, and the display is regenerated 5275 to effect the new selections. Of course, many other manipulations may be made to the background, markers, segments and other aspects of the system as described elsewhere in this application. These manipulations could be made in the same manner as those in FIG. 52. As well, the organizational hierarchy of the manipulations in the menu system in FIG. 52 could easily be varied. Some of the manipulations may have no purpose in certain applications, while some may be more important than others, warranting a change in the order or priority of the menu options.

Figure 53A:
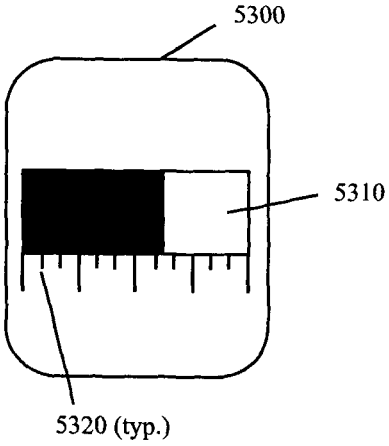
FIGS. 53A-58C present various timepiece displays, in accordance with embodiments of the invention where use is made of computer software and a touchscreen digital display; and, FIGS. 59A-62D present various timepiece displays containing time-linked information, in accordance with embodiments of the invention where use is made of computer software and a touchscreen digital display.
Figure 53B:
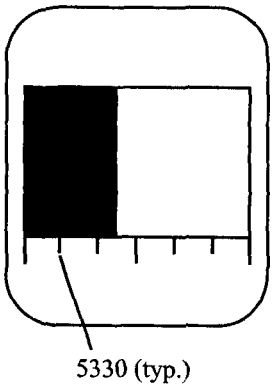
Figure 53C:
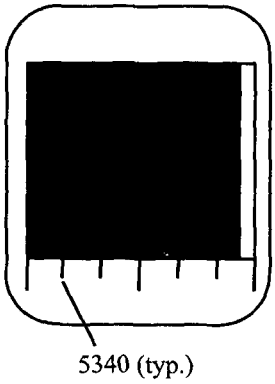

Examples of such possible embodiments on a smartphone, iPhone, iPad, digital wristwatch display, and the like are shown in FIGS. 53A-58C. The time displayed in these Figures is 7:23:56. An embodiment is shown in display 5300 in FIGS. 53A-53C. In this example, a single segment 5310 is used to present the standard units of time, as shown in FIG. 53A for the hours. Markers 5320 are used to demarcate twelve-hour intervals. In order to read the minutes, the user could, for instance, tap on or swipe the digital display, leading to a change in the display wherein only the minutes can be read, as shown in FIG. 53B. In FIG. 53B, the shape of the segment is the same as that shown in FIG. 53A, except that its size has been increased in order to permit greater differentiation between the time layers; this differentiation is reinforced through the use of different markers 5330 which demarcate ten-minute intervals. In order to read the seconds, the user could tap on or swipe the screen again, leading to a change in display wherein only the seconds can be read, again within a single (but further enlarged) segment, as shown in FIG. 53C. Markers 5340 are used to demarcate ten-second intervals, similar to markers 5330 used to demarcate ten-minute intervals.

Figure 54A:
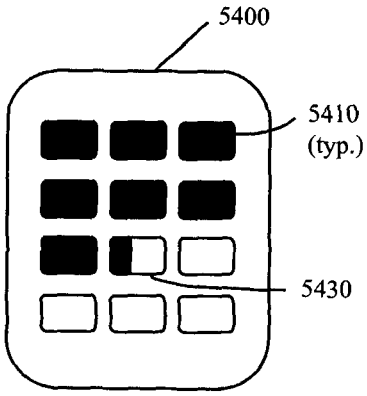
Figure 54B:
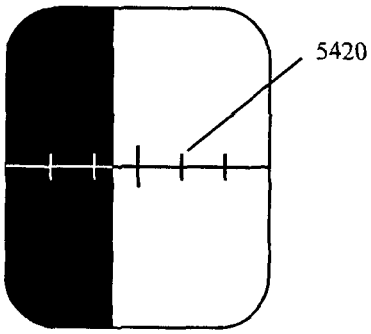
Figure 54C:
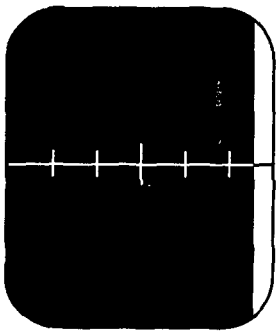
Figure 54D:
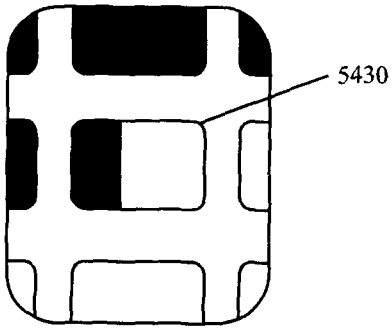

FIGS. 54A-54D provide another embodiment. Twelve segments 5410 are used to display the hours in display 5400 in FIG. 54A. In the depiction of the minutes, as shown in FIG. 54B, not only is the number of segments reduced to one, but the entire display face is effectively used as a single segment. A system of contrasting markers 5420 is employed to enable a more precise reading of the minutes; as noted, these markers could potentially be removed through a user gesture on the display. In the display of seconds in FIG. 54C, the design layout of the display does not change. An alternative display of the minutes is found in FIG. 54D; specifically, the segment 5430 in which time is progressing in FIG. 54A is magnified, allowing for a closer reading of the minutes. Magnification as such does not necessarily constitute a switching of time layers, modes or states; however, where it leads to a display where only standard unit of time can read by means of the indicator(s) and possible segment(s) on the display (and without reference to any labelling on markers), such as in FIG. 54D where only the minutes can be read (i.e., it is impossible to know the hours from the display, on the assumption that the display is fixed and cannot be manipulated to allow for all the segments 5410 to be viewed and counted), then there is a switching of time layers. As with FIG. 54B, markers could be introduced in the display in FIG. 54D by means of user interaction with the display.

Figure 55A:
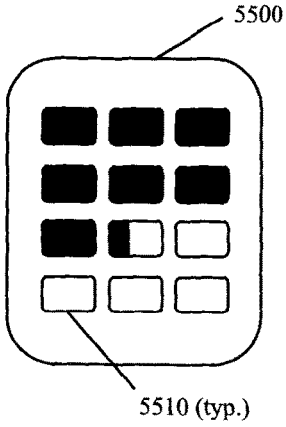
Figure 55B:
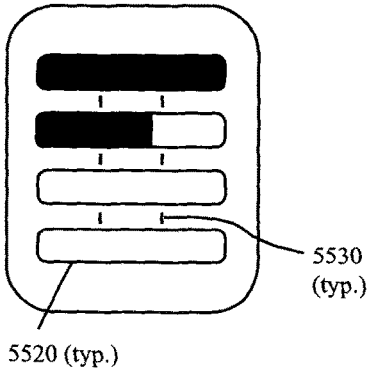
Figure 55C:
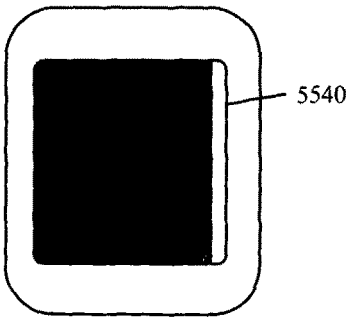
Figure 55D:
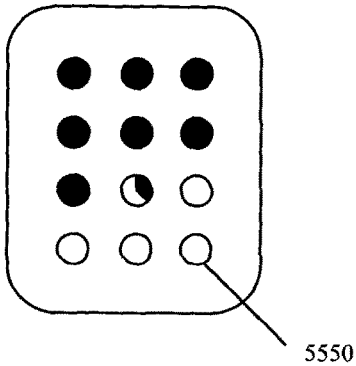
Figure 55E:
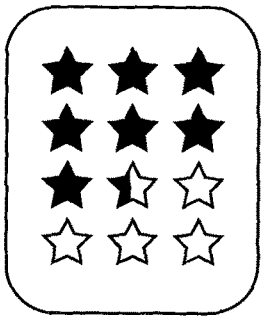
Figure 56A:
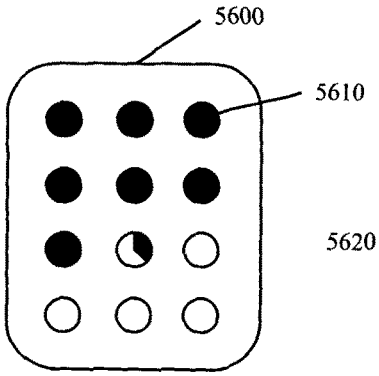
Figure 56B:
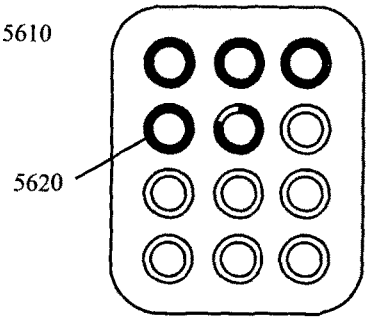
Figure 56C:
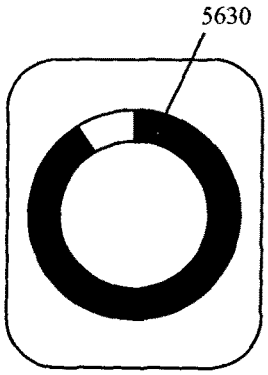
Figure 57A:
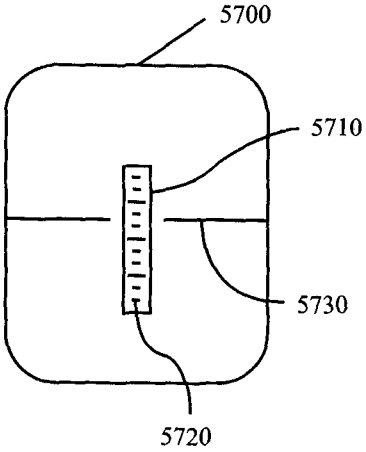
Figure 57B:
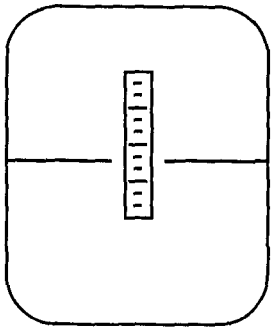
Figure 57C:
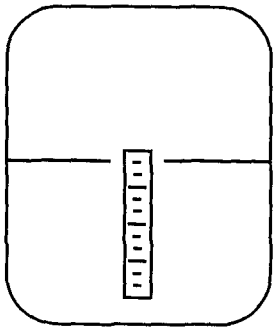

FIGS. 55A-55E provide a further such embodiment. FIGS. 55A-55C illustrate how the number and shape of segments on display 5500 could change as one switches between the hours, minutes, and seconds. In FIG. 55A, twelve segments 5510 are used to present the passage of the hours, whereas only four segments 5520 are used to depict the minutes in FIG. 55B in combination with markers 5530. In FIG. 55C, only segment 5540 is used to depict the seconds. FIGS. 55D-55E provide alternative display options 5550 for the hours, which could be viewed and selected by a combination of user gestures or interactions with the display (e.g., left or right swipe of the display, allowing the user to scroll between display options for the hours, followed by a touching or tapping on the display to select the desired display option). FIGS. 56A-56C provide another example of how the number and shape of segments may vary depending on the unit of time that is displayed. Twelve segments are used to depict the hours in FIG. 56A and the minutes in FIG. 56B; a circular form 5610 is used in the former while an annular form 5620 is used in the latter. A single annular segment 5630 is used in FIG. 56C to depict the seconds.

Figure 58A:
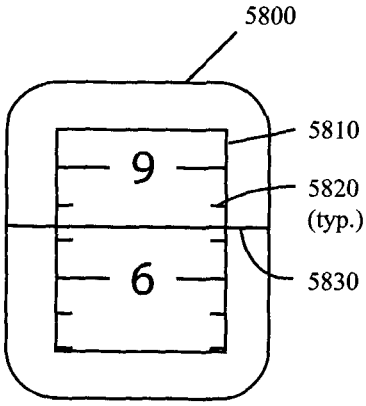
Figure 58B:
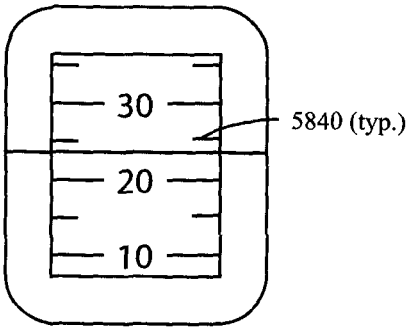
Figure 58C:
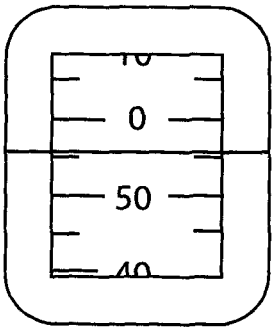

FIGS. 57A-58C illustrate embodiments where the indicator is fixed in the time displays, with the timekeeping function enabled by means of the segment and indicators thereon changing their position with respect to the indicator. For instance, in FIGS. 57A-57C, the indicator 5710 comprises two fixed lines that are placed horizontally on the visual display, at the midway point between the top and bottom of the visual display 5700. The single segment 5720 moves in a downward, vertical motion, with markers 5730 on both sides, allowing for an accurate reading time, with the fixed indicator serving as a pointer indicator with respect to the markers on the moving segment. The user may switch between the presentation of the hours in FIG. 57A, minutes in FIG. 57B, and seconds in FIG. 57C. FIGS. 58A-58C are similar to FIGS. 57A-57C except that the single segment 5810 in display 5800 is depicted as a physical cylindrical barrel whose surface serves as a rotating single segment. As the segment rotates, the indicators 5820 move downwards with the virtually revolving segment, their position continuously shifting in relation to the fixed indicator 5830. The user may switch between the presentation of the hours in FIG. 58A, minutes in FIG. 58B, and seconds in FIG. 58C. The markers 5820 and numerals used to measure the hours in FIG. 58A are different from the markers 5840 and numerals used to measure the minutes in FIG. 58B and seconds in FIG. 58B. In both sets of Figures, the fixed indicator could conceivably be shifted by the user to a new location on the display, be it for aesthetic or practical reasons.

The embodiments illustrated in FIGS. 53A-FIG. 58C provide examples of how the invention could be exploited through the use of computer software and touchscreen displays. Other similar embodiments could be envisaged. A number of touchscreen displays could, for instance, be embedded within a timepiece, with each display constituting one of the several fixed segments within the visual display, permitting flexibility and user interaction; for example, a user could tap on one of the touchscreen displays constituting the segments in order to change the colour or luminosity of the segment or all of the segments. Alternatively, one could obtain the same time displays shown in FIGS. 53A-58C without the use of a touchscreen interface, by means of different switching mechanism(s) such as a motion sensor, voice control, etc.

An important feature of the invention is that it enables, with digital displays, the incorporation of time-linked functions or information directly into the time display in a manner that is simple and visually intuitive, makes an economical use of space, and does not compromise precision in timekeeping. FIGS. 59A-62D illustrate how this feature is achieved under this invention, enabling a better visualization of the time content of information, facilitating the presentation of such information on small display devices, and enhancing the ability of users to manipulate such information on the time display. While these Figures provide examples of this feature based on digital touchscreen displays, such examples could be obtained on non-touchscreen digital displays, such as computer screens.

Figure 59A:
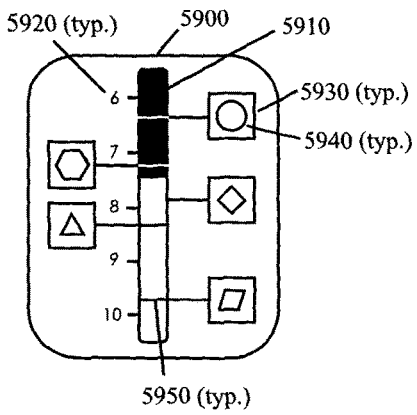

FIGS. 59A-59F provide an example of how time values and time intervals contained in information or functions can be linked with the passage of time, allowing such functions and information to be linked to, and thus efficiently integrated with, the depiction of time under the invention. The time displayed is 7:23:56. Display 5900 in FIG. 59A is a digital touchscreen display with a single segment 5910 and markers 5920 that enable the presentation of time, in this case the hours. The presentation of time is shown in a cumulative manner, with segment 5910 being progressively filled. Only a number of the hours are presented on the display; however, segment 5910 rolls in a virtual manner, allowing the user, through a gesture (e.g., swiping, flicking), to scroll up or down in order to read the other hours in the hours display. A twelve or twenty-four hour scale may be used for the hours display. As with embodiments described in FIGS. 53A-58C, a user gesture on the touchscreen display (for instance, by tapping on the segment 5910) or other switching mechanism allows for the display of the other standards units of time, such as minutes and seconds as well as months and days.

Connected to the depiction of time on display 5900 is the presentation of time-linked information, appearing in this instance in the form of icons 5930 with features 5940 in the form of diagrams, text, photos, drawings, and other types of data and information, (including embedded functionalities such as, for instance, the activation of a text message, keyboard, voice playback or command, video sequence, phone or video call; linkage to an website or application (e.g., navigation system); and the display of content generated by the user or another party). Such presentation of time-linked information may be a display option under the embodiments described in FIGS. 53A-58C as opposed to being continuously presented on the display.

The time content of the information represented by the displayed icons is made evident by means of the pointers 5950 that link the relevant time information in the icons to the presentation of time on display segment 5910, with each pointer or line indicating a specific time or interval of time. While not shown, an interval could, for instance, be demarcated by two pointers issuing from an icon or by an enlarged pointer whose length represents the interval and which takes on a different colour, degree of illumination, pattern, shape, etc. from that of segment 5910. Thus the icons could, for instance, represent calendar events, the timeline of photos taken, messages texted, notifications received or places visited, actions taken or actions to be taken for a task, etc. Many other approaches to linking the icons to the segment(s) used to display the time are possible. While the icons may be stationary until segment 5910 is completely filled (or almost completely filled) by the moving indicator, or may be shifted by means of a user gesture, they could alternatively move in a continuous manner should the presentation of time be based on a fixed indicator. Moreover, the size, shape, and positioning of the icons may change, for instance reflecting the nature of the time display design, the standard unit of time being displayed, the number of icons, the passage of time, user selection, random variation, etc.

The employment, under this invention, of an analog-form approach to time depiction enables direct, visual linkages to be made between the time display and the time-linked information and a proper visualization of time intervals. Meanwhile, the display of only one standard unit of time at a time ensures clarity regarding the linkages (i.e., no confusion as to the unit of time to which a linkage is being made, for instance the hours, minutes, or seconds); it also helps to ensure simplicity in the display, with adequate space for the presentation of time-linked information.

The ease with which time-linked information can be embedded within the time display under this invention also means that such information can be manipulated without difficulty within the display. Insofar as time-linked information is incorporated into the time display, the user is in a position to alter, add to, or subtract from, the time content of such information with rapidity. For instance, in FIG. 59A, the user could, through a user gesture on an icon (e.g., pressing, tapping, etc.), hold and slide an icon 5930 up or down the segment 5910 and attach it to a separate time value, thus rearranging the ordering of the icons along segment 5910. With segment 5910 rolling in a virtual manner, the user could move the icons across the 12-hour or 24-hour scale, for instance moving icon 5930 up to the top of the display (with the attached pointer sliding along the segment 5910 as this is being done), allowing for the segment 5910 to start scrolling as a result of this placement, and then sliding the icon to the three o'clock position. In order to change the months, days, or minutes, the user would need to switch between the standard units of time and carry out a similar sliding gesture on the display, thereby moving the pointer. These gestures to manipulate the placement of the icons are likely, in many circumstances, to be more efficient than having the user enter new time information into the icon as would required with a digital numeric time display, which may prove difficult on a small display device. Such direct gestures on the time display also have the clear benefit of allowing the user to see other time-linked information when changing the time content of an icon, which may provide important contextual information for decisions regarding such time changes.

Figure 59B:
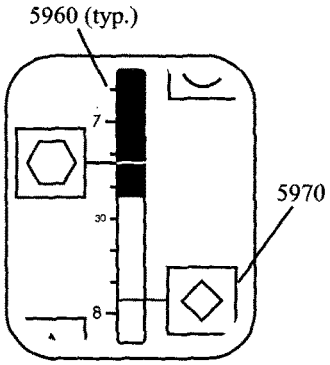
Figure 59C:
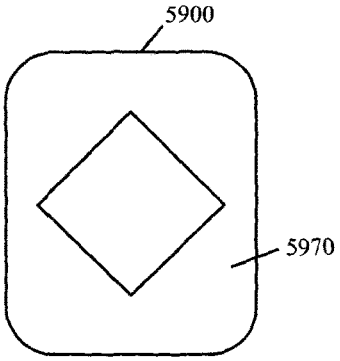

FIG. 59B illustrates how the time display would appear should the user decide to enlarge the display, without switching the standard units of time. This enlargement could be obtained by a user gesture on the touchscreen display (e.g., spreading of fingers). In this example, new markers 5960 representing shorter time intervals (one sixth of an hour, or ten minutes in effect) could appear, allowing for a more precise reading of the hours. The user may decide to see the contents of icon 5970 in closer detail through a user gesture (e.g., touching, tapping, etc.). If this is the case, the icon could be blown up to occupy the entire display, as shown in FIG. 59C. This increase in size would allow the user to view and manipulate the contents of the icon 5970 on display 5900.

Figure 59D:
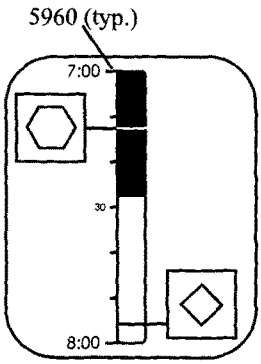

FIG. 59D shows the minutes mode of this time display. Markers 5960 have not, in comparison with FIG. 59B, changed in terms of the time intervals they represent, although their labelling has changed. FIG. 59D clearly represents the minutes mode and should be distinguished from the hours mode found in FIG. 59B. In particular, in FIG. 59D, the hours cannot be read by means of the indicator and segment (they are obtained only by reference to the extraneous labelling on the markers 5960), whereas the minutes can be fully read and measured on the visual display; by contrast, in FIG. 59B, the hours can be read on segment 5960 by scrolling through the display and measuring the hours. Although the display of the minutes in FIG. 59D could have been obtained through a wide variety of switching mechanisms, one possible mechanism could involve the user tapping on any interval between two given hours in FIG. 59A. In this case, the user would have selected the seven-to-eight o'clock interval in FIG. 59A in order to arrive at FIG. 59D; however, the user may have easily selected another hour interval, such as the nine-to-ten hour interval, in order to see, in more detail (under the minutes mode), time-related information relevant for this hour period.

Note that switching between the hours mode in FIG. 59A to the minutes mode in FIG. 59D enables a better spacing of time-linked icons. Indeed, the nesting approach adopted under this invention enables the user to modify the level at which time-linked information is to be viewed, i.e., the time layer, mode or state within which such information is to be displayed. This type of control gives the user useful flexibility in deciding how to view, introduce, or manipulate time-linked information in the time display. For instance, for disc jockey (DJ) applications that could be connected to a time display under this invention, viewing of the time-linked information, namely, the ordering of songs across time, may best be performed in the minutes mode given that most songs are typically less than ten minutes. In this mode, the user could select the songs to be played and their time of playing. The user could also rearrange the songs by dragging selected song(s) from one part of the time display to another, leading to an adjustment of their starting times. However, as one song moves to another, switching to the seconds mode may become a priority; operating in the seconds mode would allow the user to see the precise starting and ending points of songs and allow the user, through the DJ software, to create innovative song transitions. Switching to the seconds mode would also allow the user to see a song progress more clearly, second by second, and allow the user to manipulate the speed of the song more precisely, for instance through a gesture on the display. At the same time, moving to the hours mode would have the benefit of enabling the user to see the overall structure of the playlist over the course of an extended period, such as an evening. A user working in the hours mode could ensure that appropriate themes and tempos are introduced at the right points or played over the right intervals in the course of an evening. Thus; as can be seen from this example, time-linked information may be optimally viewed in different layers, modes or states of the time display depending on the nature of the time-linked information and the objectives of the user.

Figure 59E:
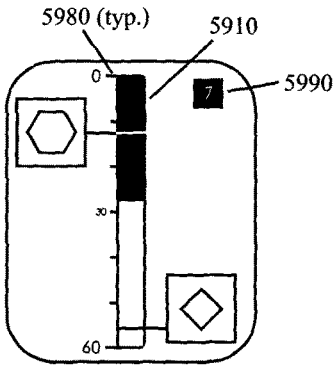
Figure 59F:
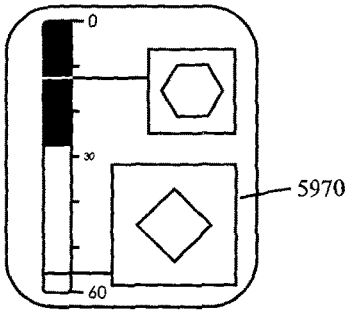

FIG. 59E provides a similar presentation of the minutes mode. The markers 5980 have been relabelled, while an optional separate digital numeric time display 5990 has been introduced in the display, serving as a reminder of the hour interval to which these displayed minutes are related. This separate display, which is not integral to the display of time under this invention, could prove useful as users may be switching to other hour intervals besides the one that is associated with the current time (for instance, the user may wish to view an hour interval later in the day in order to see an upcoming calendar appointment). This separate display could also include day and month information. FIG. 59F similarly provides a display of the minutes, with an alternative positioning of the time display segment and icons. Icon 5970 has been enlarged in response to a user gesture, allowing for a close examination of the information or functionalities contained in the icon.

The ability to see time-linked information easily and intuitively on a time display, and corresponding time values and time intervals, in the manner enabled by this invention enhances timer functions, where presumably the context surrounding time information, as revealed by time-linked icons or other means, is both relevant and time-sensitive and thus usefully observed closely on the display. This increased scope for information-rich timer functions would apply especially for multi-functional or geo-sensitive computing devices with time displays, such as civilian and military equipment, smart phones, tablets, and smart watches, where the timer functions (e.g., stopwatch, countdown, measured time interval) could be linked to a separate activity, process or functionality. A separate event could provide, for instance, the trigger for terminating the stopwatch function or starting the countdown or other timer function; it could also provide the basis for determining the length of the pre-set interval of time to be measured. For example, instead of the stopwatch (alternatively, countdown) function being terminated (started) by the user, it could be made to terminate (start) upon the occurrence of an external event, for instance, by the arrival of the user at a certain location (or being within a certain radius from a certain location), the receipt of a message or notification, the execution of an activity or task by the user or a third party, etc. The nature of the specific event could determine the time interval to be measured with a timer function; for example, arrival at one location or completion of one activity may generate a different countdown time interval than arrival at another location or completion of another activity. The lengths of these different intervals may be preset by the user or may be independently determined.

The timer function could be linked a functionality, such as the loading, execution, or playing of a program, application, webpage, song, video, or other item, with the indicator measuring the elapsed time (similar to a stopwatch) or alternatively the expected time to completion of the loading, execution or playing of the item (similar to a countdown). Navigation systems and fitness applications provide examples of functionalities that could be linked to timer functions, for instance the expected driving or walking time for a specific route being the time interval over which time is measured.

Figure 60:
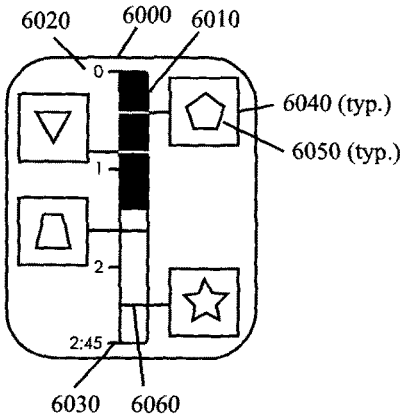

FIG. 60 illustrates how time-linked information can be embodied within a stopwatch, countdown or other timer function under this invention. Display 6000 contains a segment 6010 in which time information is presented by means of the segment being gradually filled in cumulative fashion, with markers 6020 (the timed interval could alternatively be inserted within the display of the current time in FIG. 59A through the use of specific icons, in order to avoid the need to switch displays). The display is in the hours mode. The labelling on marker 6030 indicates that a timer function is being employed (i.e., two hours and forty-five minutes being the time period subject to measurement). In this Figure, the time interval has been preset; however, as noted earlier, the length of the interval may not necessarily be immediately defined, being linked to the occurrence of a separate event or to another functionality. Icons 6040 containing specific data, information, or functionalities 6050 are linked, through pointers 6060, directly to the segment in which the timer information is presented. These icons may be passive, for instance serving as a reminder of a task to be performed at a certain moment or the end of a task just performed, or may be active, for instance, with a functionality being activated when the specified moment of time passes. The icons may also be linked to the occurrence of a separate event, which takes on a time value as it transpires, and thus not appearing on the display until this moment. A user seeking to obtain a more precise reading of the elapsed time could switch the display in order to obtain a display of the elapsing minutes or seconds. As mentioned, time-linked information may best be viewed in different layers, modes or states of the time display depending on the nature of such information and user objectives.

Figure 61A:
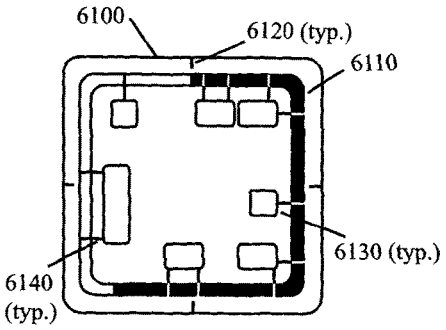
Figure 61B:
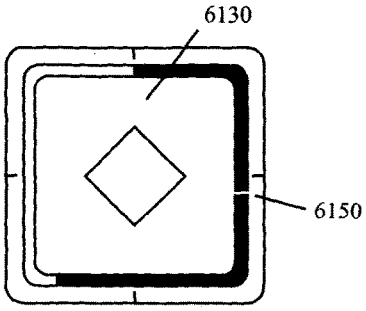

FIG. 61A is similar to FIG. 59A in depicting the hours except that an alternative time display design is employed. The time displayed is 7:23:56. The digital touchscreen display 6100 comprises a single segment 6110 taking the shape of a square ring with rounded corners. Markers 6120 divide this segment into four intervals. Icons 6130 with time-linked functions or information occupy the display with pointers 6140 indicating the relevant time point or time interval. A user seeking to view the information contained in an icon or enable its functionality may, though a gesture on the touchscreen display, select the icon. If, for instance, icon 6130 is selected, its size and presentation could change and fill the space within segment 6110 as shown in FIG. 61B. This would allow the user to obtain a closer view of the icon and its contents—which may be static or dynamic—without losing track of the current time, unlike the case in FIG. 59C. It would also allow the user to change the time content of the icon, as revealed by pointer 6150; for instance, through pre-specified gestures on the display enabling a switching between the different standard units of time, the user could change the month, day, or minutes. The hour could be changed by dragging pointer 6150 through the segment 6110; in this case, the size of the indicator might change as this action is performed (for instance, assuming the length of an hour interval or a fraction of an hour interval such as half an hour) in order to facilitate a discrete selection of the new time information. The markers might change in number as the user switches through the different units of time in order to ensure accuracy in selection; as this is done, the pointer 6150 might also change in size.

Note that in FIG. 61A the markers 6120 are placed equidistantly around the segment 6110. However, based on a selected user preference, the number and position of these markers might change in light of the number and clustering of icons 6130. For instance, should more icons appear in the three to six o'clock position, this three-hour time interval could be made to stretch out, taking up proportionately more space on segment 6110 than other intervals where the clustering of icons is less present. This adjustment could be automatic or be the result of the user dragging one of the markers 6120 in order to stretch out the interval. Such adjustments in the markers could occur for other reasons, for instance in response to certain type of icons or priority levels of time content information.

Figure 62A:
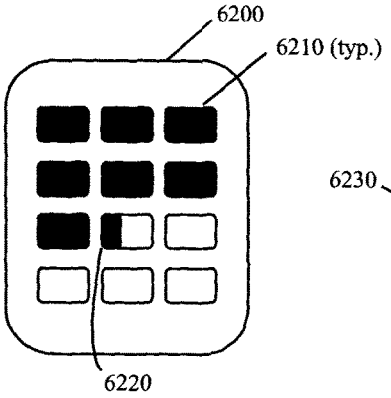
Figure 62B:
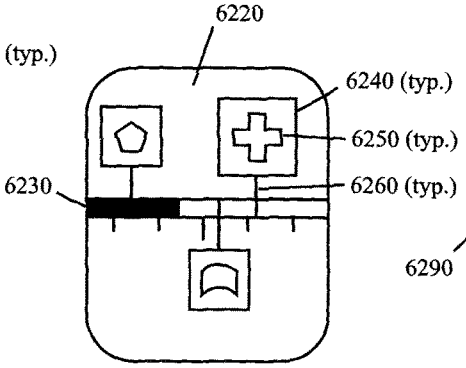

FIG. 62A is similar to FIG. 3A, with a simple presentation of the time on display 6200, in this case the hours mode. The time displayed is 7:23:56. No time-linked icons are introduced. However, should the user seek to view time-linked functions or information, one of the segments 6220 could be selected, allowing the user to see the time-linked icons present within the selected hour interval. FIG. 62B, representing a selection of the eighth hour 6220 in FIG. 62A, shows the minutes mode and presents the current time in respect of the minutes. Time-linked icons 6240 with features 6250 are presented in this display of the minutes, with pointers 6260 linking the time information in the icons to the relevant minutes within the eighth hour in the segment 6230.

Figure 62C:
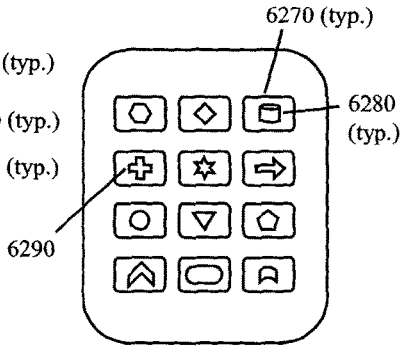
Figure 62D:
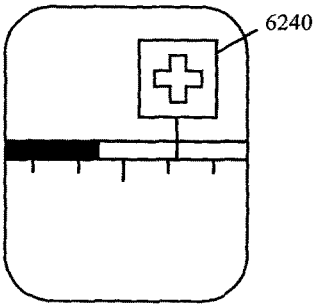

FIG. 62C represents a display option where the user is able to filter the time-linked icons presented on the display. Icons 6270 with features 6280 are presented in a horizontal grid; through a user gesture, more icons could be presented, in a scrolling fashion. The user may decide to establish a filter based on icon 6290. In selecting this icon, the user would find, in moving back to the display of the minutes as shown in FIG. 62D, that only icons of this nature are presented in the display, as shown by icon 6240, in contrast to FIG. 62B where all such icons are displayed. The selection of any particular icon might lead to a unique time display design in FIG. 62D. FIG. 62C may alternatively represent the display of options within a time-linked application; the selection of any one or more options could lead to a specific time display with time-linked information. The design of time displays and configuration of time-linked information could thus reflect application-specific variables, e.g., type of person, activity, task or procedure, location, priority level, level of difficulty, etc. Time display designs could, under this invention, become highly customized to user needs and preferences while also reflecting the features and design objectives of time-linked applications.

Furthermore, FIGS. 62A and 62C show how other functionalities can be embedded within the time display in a simple, uncluttered manner under this invention. For instance, through a specific motion or by other means, the user could switch from the display of time in FIG. 62A to the display of other functionalities as shown for instance in FIG. 62C, where the segments used for presenting the time could equally be used to present a menu of applications or options, present selected items (e.g., photos, songs), indicate actions taken or to be undertaken (with possibly their own time displays as shown in FIG. 62D, if an icon is selected), or present application notifications. The time display design in FIG. 62A could also be used to indicate (not shown) the occurrence of a process, task or activity, e.g., booting up of an electronic device, loading of a program, application or media file, establishing a connection to a wireless network, etc. Moreover, the time display design could be used, when not displaying the time, to indicate the status or degree of completion of a function, process, task or activity, or more generally a proportional measurement, e.g., level of power supply, progress made with a task or project, proportion of distance covered in a route, etc. Functionalities could be built into the time display even while it is presenting the time, e.g., a slide to unlock function on a touchscreen display device could be embedded within a selected segment or be enabled by user movement of the indicator, selected photos could be displayed in filled segments, etc.

The present invention has been described with regard to one or more embodiments. However, it will be apparent to persons skilled in the art that a number of variations and modifications can be made without departing from the scope of the invention as defined in the claims.

All citations are hereby incorporated by reference.

What is claimed is:

1. A timepiece comprising:

a clock for measuring a passage of time, in standard units of hours and said minutes, and having a current value;

a visual display, for displaying only one of said hours and said minutes of said current value at a time; and a selecting device for selecting one of said hours and said minutes of said current value and presenting only said selected one of said hours and said minutes of said current value, on said visual display;

said current value of said selected one of said hours and said minutes being represented by the relative position of an indicator within a defined space on said visual display.

2. The timepiece of claim 1, wherein said defined space comprises at least one segment, and said current value is represented by the relative position of said indicator with respect to said at least one segment.

3. The timepiece of claim 2, wherein the same at least one segment is used to present each of said hours and said minutes of said current value.

4. The timepiece of claim 2, wherein said current value is represented by said indicator whose relative position with respect to said at least one segment changes with the passage of time.

5. The timepiece of claim 2, wherein said at least one segment comprises a number of segments in said visual display which is a factor of one of 60, 12, and 24.

6. The timepiece of claim 1, further comprising a customizing device allowing a user to customize the visual display.

7. The timepiece of claim 1, wherein said selecting device is selected from the group consisting of touchscreen display, pushbutton, sliding switch, roller switch, knob, rotating bezel, rotating disc, toggle switch, flip switch, swivel switch, pull switch, capacitive touch sensor, infrared sensor, optical sensor, motion detector, voice or sound control system, a software application and wireless connection.

8. The timepiece of claim 1, wherein said visual display comprises a mechanical movement selected from the group consisting of moving objects, belts, pistons, shutters, wheels, drums, and cylinders, or a set of lights, LEDs (light emitting diodes), an LCD (liquid crystal display), a plasma display, electronic paper, electronic ink or a projection display.

9. The timepiece of claim 1, wherein the clock monitors the current time of day.

10. The timepiece of claim 1, wherein said visual display is operable to present fractions of a standard unit of time.

11. The timepiece of claim 1, wherein said clock for measuring a passage of time, measures time minutes and seconds, and said selecting device is operable to select between one of said hours, said minutes and said seconds, resenting only said selected one of said hours, said minutes and said seconds on said visual display at a time.

12. The timepiece of claim 1, further comprising a timer function for tracking the passage of time over an interval of time.

13. The timepiece of claim 1, further comprising a linking device for linking information containing a time value with the passage of time and presenting the linked information on said visual display.

14. The timepiece of claim 1, wherein said standard units further comprise seconds and sixtieths of a second, and said providing a selecting device comprises providing a selecting device for selecting between one of said hours, said minutes, said seconds and said sixtieths of a second, and presenting only said selected one of said hours, said minutes, said seconds and said sixtieths of a second, on said visual display.

15. The timepiece of claim 1, further comprising means for linking information containing a time interval with the passage of time and presenting the linked information on said visual display.

16. The timepiece of claim 1, further comprising a customizing device allowing a user to customize the indicator.

17. The timepiece of claim 1, wherein the timepiece does not include any alphanumeric characters on the visual display.

18. The timepiece of claim 1, wherein the selecting device selects back and forth between said hours and said minutes of said current value automatically.

19. A time display for a clock system having a clock for measuring a passage of time, in standard units of hours and minutes, and having a current value, the time display comprising:

a visual display, for displaying only one of said hours and said minutes of said current value at a time; and a selecting device for selecting one of said hours and said minutes of said current value and presenting only said selected one of said hours and said minutes of said current value, on said visual display;

where said current value of said selected one of said hours and said minutes is represented by the relative position of an indicator within a defined space on said visual display.

20. A method of presenting time information comprising:

operating a clock to measure a passage of time, in standard units of hours and minutes, and to generate a current value;

providing a visual display, for displaying only one of said hours and said minutes of said current value at a time;

providing a selecting device for selecting one of said hours and said minutes of said current value and presenting only said selected one of said hours and said minutes of said current value, on said visual display; and providing an indicator, where said current value of said selected one of said hours and said minutes is represented by the relative position of said indicator within a defined space on said visual display.

* * * * *